US007647143B2

(12) United States Patent
Ito et al.

(10) Patent No.: US 7,647,143 B2
(45) Date of Patent: Jan. 12, 2010

(54) SPEED CONTROL DEVICE FOR WATER JET PROPULSION BOAT

(75) Inventors: Kazumasa Ito, Shizuoka-ken (JP); Motohiro Oshiro, Shizuoka-ken (JP); Yoshimasa Kinoshita, Shizuoka-ken (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 934 days.

(21) Appl. No.: 11/135,890

(22) Filed: May 24, 2005

(65) Prior Publication Data

US 2005/0273224 A1 Dec. 8, 2005

(30) Foreign Application Priority Data

May 24, 2004 (JP) ..... 2004-152777

(51) Int. Cl.
*B63H 25/42* (2006.01)

(52) U.S. Cl. ..... 701/21; 440/2

(58) Field of Classification Search ..... 701/21, 701/23, 36; 477/91; 440/2, 86, 87, 84
See application file for complete search history.

(56) References Cited

U.S. PATENT DOCUMENTS

| | | | | |
|---|---|---|---|---|
| 3,183,879 | A | | 5/1965 | Heidner |
| 4,423,630 | A | | 1/1984 | Morrison |
| 4,445,473 | A | | 5/1984 | Matsumoto |
| 4,492,195 | A | | 1/1985 | Takahashi et al. |
| 4,556,005 | A | | 12/1985 | Jackson |
| 4,767,363 | A | | 8/1988 | Uchida et al. |
| 4,836,809 | A | * | 6/1989 | Pelligrino ..... 440/2 |
| 4,949,662 | A | | 8/1990 | Kobayashi |
| 4,961,396 | A | | 10/1990 | Sasagawa |
| 4,971,584 | A | | 11/1990 | Inoue et al. |
| 4,972,792 | A | | 11/1990 | Yokoyama et al. |
| 4,989,533 | A | | 2/1991 | Horuichi |
| 5,094,182 | A | | 3/1992 | Simner |
| 5,113,777 | A | | 5/1992 | Kobayashi |
| 5,118,315 | A | | 6/1992 | Funami et al. |
| 5,144,300 | A | | 9/1992 | Kanno |

(Continued)

FOREIGN PATENT DOCUMENTS

CA 2271332 2/2000

(Continued)

OTHER PUBLICATIONS

Co-pending U.S. Appl. No. 11/083,290, filed Mar. 17, 2005. Title: Engine Control Device. Inventor: Ishida et al.

(Continued)

*Primary Examiner*—Dalena Tran
(74) *Attorney, Agent, or Firm*—Knobbe, Martens, Olson & Bear LLP

(57) ABSTRACT

A watercraft can have a controller that can change a speed mode between a speed set mode and a regular mode in response to an operation of an auto cruise switch. The controller can return the speed mode to a regular mode under various conditions. For example, but without limitation, when an engine rotational speed reaches "zero" or nearly "zero" (i.e., an engine operation stops or nearly stops) while the speed mode is in the speed set mode. The controller can be configured to follow the actuation of the cruise switch only when the switch is operated in the regular mode.

15 Claims, 10 Drawing Sheets

U.S. PATENT DOCUMENTS

| | | | | |
|---|---|---|---|---|
| 5,167,546 | A | 12/1992 | Whipple | |
| 5,167,547 | A | 12/1992 | Kobayashi et al. | |
| 5,169,348 | A | 12/1992 | Ogiwara et al. | |
| 5,184,589 | A | 2/1993 | Nonaka | |
| 5,199,261 | A | 4/1993 | Baker | |
| 5,203,727 | A | 4/1993 | Fukui | |
| 5,244,425 | A | 9/1993 | Tasaki et al. | |
| 5,350,325 | A | 9/1994 | Nanami | |
| 5,352,138 | A | 10/1994 | Kanno | |
| 5,366,394 | A | 11/1994 | Kanno | |
| 5,367,970 | A | 11/1994 | Beauchamp et al. | |
| 5,408,948 | A | 4/1995 | Arii et al. | |
| 5,429,533 | A | 7/1995 | Kobayashi et al. | |
| 5,474,007 | A | 12/1995 | Kobayashi | |
| 5,520,133 | A | 5/1996 | Wiegert | |
| 5,538,449 | A | 7/1996 | Richard | |
| 5,591,057 | A | 1/1997 | Dai et al. | |
| 5,603,644 | A | 2/1997 | Kobayashi et al. | |
| 5,665,025 | A | 9/1997 | Katoh | |
| 5,687,694 | A | 11/1997 | Kanno | |
| 5,697,317 | A | 12/1997 | Pereira | |
| 5,707,264 | A | 1/1998 | Kobayashi et al. | |
| 5,713,297 | A | 2/1998 | Tani et al. | |
| 5,805,054 | A | 9/1998 | Baxter | |
| 5,826,557 | A | 10/1998 | Motoyama et al. | |
| 5,839,700 | A | 11/1998 | Nedderman, Jr. | |
| 5,904,604 | A | 5/1999 | Suzuki et al. | |
| 5,908,006 | A | 6/1999 | Ibata | |
| 5,941,188 | A | 8/1999 | Takashima | |
| 5,988,091 | A | 11/1999 | Willis | |
| 6,032,605 | A | 3/2000 | Takashima | |
| 6,032,653 | A | 3/2000 | Anamoto | |
| 6,038,995 | A | 3/2000 | Karafiath et al. | |
| 6,062,154 | A | 5/2000 | Ito | |
| 6,086,437 | A | 7/2000 | Murray | |
| 6,102,755 | A | 8/2000 | Hoshiba | |
| 6,116,971 | A | 9/2000 | Morikami | |
| 6,135,095 | A | 10/2000 | Motose et al. | |
| 6,138,601 | A | 10/2000 | Anderson et al. | |
| 6,148,777 | A | 11/2000 | Motose et al. | |
| 6,159,059 | A | 12/2000 | Bernier et al. | |
| 6,168,485 | B1 | 1/2001 | Hall et al. | |
| 6,171,159 | B1 | 1/2001 | Shen et al. | |
| 6,174,210 | B1 | 1/2001 | Spade et al. | |
| 6,178,907 | B1 | 1/2001 | Shirah et al. | |
| 6,202,584 | B1 | 3/2001 | Madachi et al. | |
| 6,213,044 | B1 | 4/2001 | Rodgers et al. | |
| 6,216,624 | B1 | 4/2001 | Page | |
| 6,220,904 | B1 * | 4/2001 | Hoshiba et al. | 440/1 |
| 6,227,919 | B1 | 5/2001 | Blanchard | |
| 6,244,914 | B1 | 6/2001 | Freitag et al. | |
| 6,273,771 | B1 | 8/2001 | Buckley et al. | |
| 6,305,307 | B1 | 10/2001 | Yokoya | |
| 6,314,900 | B1 | 11/2001 | Samuelsen | |
| 6,332,816 | B1 | 12/2001 | Tsuchiya et al. | |
| 6,336,833 | B1 | 1/2002 | Rheault et al. | |
| 6,336,834 | B1 | 1/2002 | Nedderman, Jr. et al. | |
| 6,386,930 | B2 | 5/2002 | Moffet | |
| 6,390,862 | B1 | 5/2002 | Eichinger | |
| 6,405,669 | B2 | 6/2002 | Rheault et al. | |
| 6,415,729 | B1 | 7/2002 | Nedderman, Jr. et al. | |
| 6,428,371 | B1 | 8/2002 | Michel et al. | |
| 6,428,372 | B1 | 8/2002 | Belt | |
| 6,443,785 | B1 | 9/2002 | Swartz et al. | |
| 6,478,638 | B2 | 11/2002 | Matsuda et al. | |
| 6,508,680 | B2 | 1/2003 | Kanno | |
| 6,511,354 | B1 | 1/2003 | Gonring et al. | |
| 6,523,489 | B2 | 2/2003 | Simzrd et al. | |
| 6,530,812 | B2 | 3/2003 | Koyano et al. | |
| 6,551,152 | B2 | 4/2003 | Matsuda et al. | |
| 6,565,397 | B2 | 5/2003 | Nagafusa | |
| 6,568,968 | B2 | 5/2003 | Matsuda et al. | |
| 6,668,796 | B2 | 12/2003 | Umemoto et al. | |
| 6,695,657 | B2 | 2/2004 | Hattori | |
| 6,709,302 | B2 | 3/2004 | Yanagihara | |
| 6,709,303 | B2 | 3/2004 | Umemoto et al. | |
| 6,722,302 | B2 | 4/2004 | Matsuda et al. | |
| 6,722,932 | B2 | 4/2004 | Yanagihara | |
| 6,732,707 | B2 | 5/2004 | Kidokoro et al. | |
| 6,733,350 | B2 | 5/2004 | Iida et al. | |
| 6,776,676 | B2 | 8/2004 | Tanaka et al. | |
| 6,783,408 | B2 | 8/2004 | Uraki et al. | |
| 6,805,094 | B2 | 10/2004 | Hashimoto et al. | |
| 6,827,031 | B2 | 12/2004 | Aoyama | |
| 6,855,014 | B2 | 2/2005 | Kinoshita et al. | |
| 6,863,580 | B2 | 3/2005 | Okuyama | |
| 6,884,128 | B2 | 4/2005 | Okuyama et al. | |
| 6,886,529 | B2 | 5/2005 | Suzuki et al. | |
| 6,990,953 | B2 | 1/2006 | Nakahara et al. | |
| 6,997,763 | B2 | 2/2006 | Kaji | |
| 7,037,147 | B2 | 5/2006 | Kinoshita et al. | |
| 7,077,713 | B2 | 7/2006 | Watabe et al. | |
| 7,168,995 | B2 | 1/2007 | Masui et al. | |
| 7,175,490 | B2 | 2/2007 | Kanno et al. | |
| 2002/0028613 | A1 * | 3/2002 | Matsuda et al. | 440/1 |
| 2002/0155766 | A1 * | 10/2002 | Hattori | 440/88 |
| 2003/0000500 | A1 | 1/2003 | Chatfield | |
| 2003/0089166 | A1 | 5/2003 | Mizuno et al. | |
| 2004/0069271 | A1 | 4/2004 | Kanno et al. | |
| 2004/0147179 | A1 | 7/2004 | Mizuno et al. | |
| 2005/0009419 | A1 | 1/2005 | Kinoshita | |
| 2005/0085141 | A1 | 4/2005 | Motose | |
| 2005/0263132 | A1 | 12/2005 | Yanagihara | |
| 2005/0273224 | A1 | 12/2005 | Ito et al. | |
| 2005/0287886 | A1 | 12/2005 | Ito et al. | |
| 2006/0004502 | A1 | 1/2006 | Kaneko et al. | |
| 2006/0037522 | A1 | 2/2006 | Kaneko et al. | |
| 2007/0021015 | A1 | 1/2007 | Kinoshita et al. | |

FOREIGN PATENT DOCUMENTS

| | | |
|---|---|---|
| JP | 06-137248 | 5/1994 |
| JP | 7-40476 | 9/1995 |
| JP | 2001-152895 | 6/2001 |
| JP | 2001-329881 | 11/2001 |
| JP | 2002-180861 | 6/2002 |
| JP | 2004-092640 | 3/2004 |
| JP | 2004-137920 | 5/2004 |
| WO | WO 00/40462 | 7/2000 |

OTHER PUBLICATIONS

Co-pending U.S. Appl. No. 11/335,996, filed Jan. 20, 2006. Title: Operation Control System for Small Boat. Inventor: Kinoshita et al.
Co-pending U.S. Appl. No. 11/336,711, filed Jan. 20, 2006. Title: Operation Control System for Planing Boat. Inventor: Kinoshita et al.
Advertisement for trim adjuster for Sea-Doo watercraft—Personal Watercraft Illustrated, Aug. 1998.
Advertisement for trim adjuster—Jet Sports, Aug. 1997.
Advertisement for Fit and Trim and Fit and Trim II—Jet Sports. Aug. 1996.

* cited by examiner

SPEED CONTROL DEVICE FOR WATER JET PROPULSION BOAT

PRIORITY INFORMATION

The present application is based on and claims priority under 35 U.S.C. § 119 to Japanese Patent Application Serial No. 2004-152777, filed May 24, 2004, the entire contents of which is hereby expressly incorporated by reference.

BACKGROUND OF THE INVENTIONS

1. Field of the Inventions

The present inventions relate generally to speed control devices for watercraft, and more particularly, speed control devices configured to switch automatically between regular and cruise control modes.

2. Description of the Related Art

When driving a watercraft into or out of a marina, operators must drive at speeds lower than about five miles per hour. These areas are all often referred to as "No Wake Zones." Operating a boat at such a low speed can be tiresome.

For example, watercraft that include throttle levers that are biased toward a closed position, such as those used on personal watercraft and some jet boats, require the operators to hold the throttle lever with their fingers or foot in a position so as to hold the throttle lever at a precise location so that the watercraft will move only at a slow speed. Thus, more recently, some small watercraft and other jet propelled watercraft have been provided with cruise control features.

For example, Japanese Patent Publication No. 2002-180861A discloses a jet propelled boat that has an automatic cruise control system. This cruise control system includes means for allowing an operator to set a watercraft speed or an engine speed to a predetermined value. This cruise control system also includes a switch for allowing the operator to cause the cruise control system to maintain a current speed or to allow a user to choose between a number of preset speeds. Further, the operator can operate the switch again or operate a separate switch for turning off the cruise control. After the cruise control is turned off, the control of the engine power output returns to a normal mode operation, e.g., the throttle valve is directly controlled by the operator.

SUMMARY OF THE INVENTION

An aspect of at least one of the inventions disclosed herein includes the realization that the environment of a watercraft raises certain issues with respect to cruise controls. For example, when operating a watercraft in rough water, the operator and/or passengers on the watercraft can experience a "bumpy ride." Thus, it is possible that an operator of a watercraft that is running on rough water can accidentally touch one of the cruise control switches, and thereby unintentionally shut off or turn on the cruise control. Thus, a switch for operating a cruise control system on a watercraft can be configured to require that the operator depress or actuate the switch for a predetermined amount of time before the cruise control operation is changed. Other realizations are noted below.

Thus, in accordance with an embodiment, a speed control device is provided for a water jet propulsion boat that includes a power output request device and an engine adapted to operate in response to an operation of the power output request device by a rider. The speed control device can comprise a speed setting operator configured to be operated by the rider, a speed setting operation detecting device configured to detect an operational condition of said speed setting operator, and a speed mode changing device configured to change a speed mode based upon a detection result of said speed setting operation detecting device between a regular mode in which the engine operates in response to an operation of said drive operator by the rider and a speed set mode in which said water jet propulsion boat runs at a preset running speed or at a preset engine rotational speed. The speed control device can also include an engine rotational speed detecting device configured to detect a rotational speed of the engine, and a speed mode returning device configured to return the speed mode from the speed set mode to the regular mode when a detection value detected by said engine rotational speed detecting device in the speed set mode is zero or less than a predetermined value.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

Figure 1:
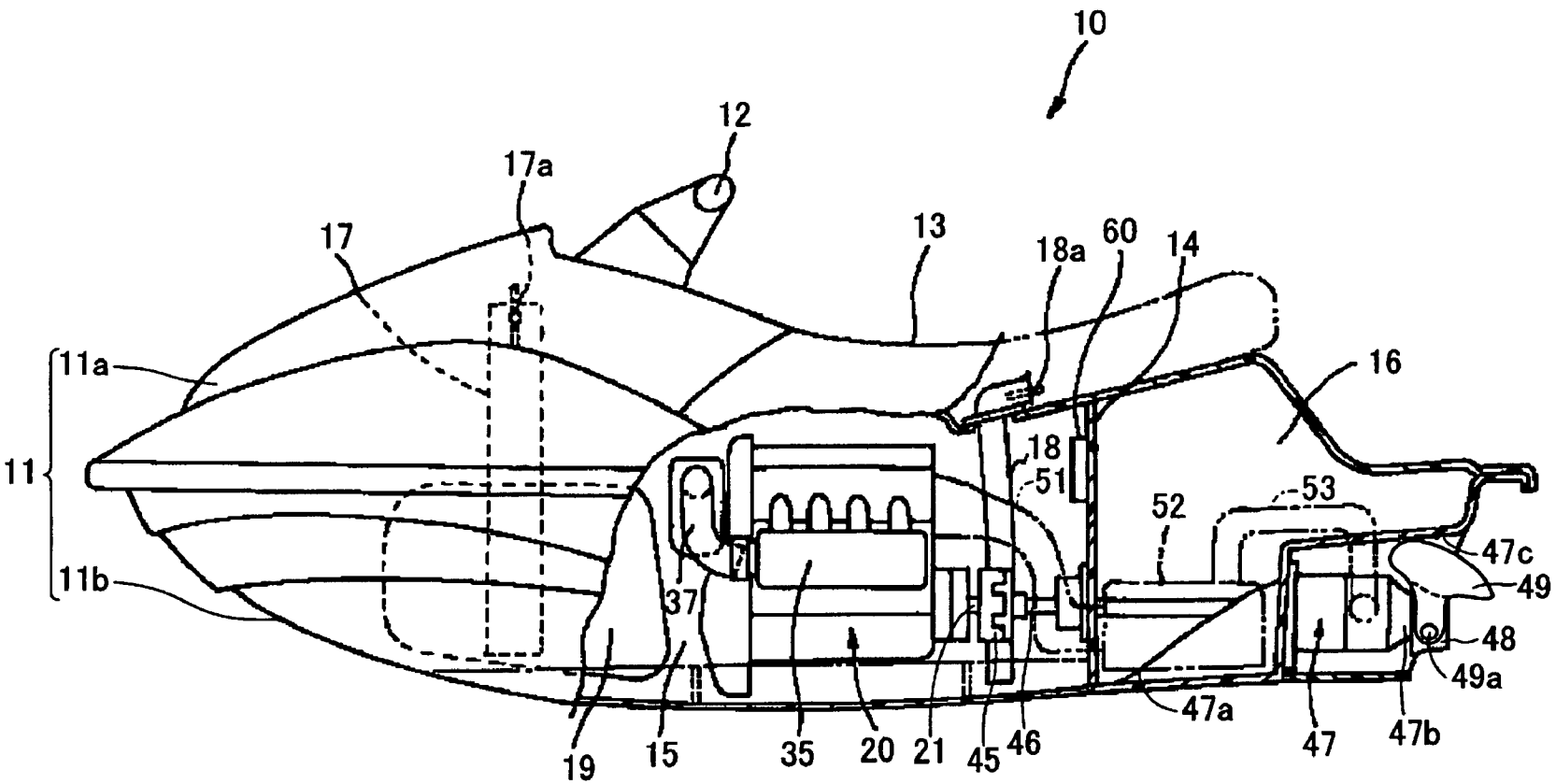
FIG. 1 is a side elevational and partial cutaway view of a personal watercraft including a speed control device constructed in accordance with an embodiment.

FIG. 1 is a schematic side elevational and partial cutaway view of a personal watercraft 10 having a speed control device according to an embodiment. The embodiments disclosed herein are described in the context of a personal watercraft having a water jet type propulsion system because the embodiments disclosed herein have particular utility in this context. However, the embodiments and inventions herein can also be applied to other boats having other types of propulsion units as well as other types of vehicles.

The watercraft 10 includes a hull 11 including an upper deck section 11*a* and a lower hull section 11*b*. The hull 11 includes a bow section toward a forward end thereof and a stern section toward a rearward end thereof.

A steering device 12 can be disposed generally in about the center of the watercraft 10. A seat 13 can be disposed toward the rear of the steering device 12. The area including the seat 13 and the steering device 12 generally represents an operator's area from which an operator can operate the watercraft 10.

The upper deck section 11*a* and the lower hull section 11*b* can be formed from one or a plurality of parts connected together. In the illustrated embodiment, the upper deck section 11*a* and the lower hull 11*b* are joined along a bond flange in a known manner.

The upper deck section 11*a* and the lower hull section 11*b* can also define an interior compartment within the watercraft 10. For example, the interior of the hull 11 can be configured to form an engine compartment. The interior of the hull 11 can include one or a plurality of different compartments therein. In the illustrated embodiment, a bulkhead 14 divides the interior of the hull 11 into an engine compartment 15 and a pump compartment 16 which is disposed rearwardly from the engine compartment 15.

Preferably, the watercraft 10 includes an air ventilation system for allowing air to flow into and out of the engine compartment 15. In the illustrated embodiment, air ducts 17, 18 are disposed at forward and rearward portions of the engine compartments 15, respectively. Generally, each air duct 17, 18 can extend generally vertically between a top portion of the hull 11 and a bottom portion of the engine compartment 15.

The air ducts 17, 18 can be configured to guide ambient air in through their top ends disposed in the vicinity of the upper deck section 11*a* and out through their lower ends disposed near a lower portion of the engine compartment 15. Each of the air ducts 17, 18 can include water preclusion mechanisms that can be opened and closed.

For example, the air ducts 17, 18 include valves 17*a*, 18*a*, respectively. The valves 17*a*, 18*a* can be opened to allow ambient air to flow into and out of the engine compartment 15. Additionally, the valves 17*a*, 18*a* can be closed so as to prevent water from entering the engine compartment 15, for example, when the watercraft 10 is capsized. Additional or other waterproofing devices can also be provided.

A fuel tank 19 can also be disposed within the interior of the hull 11. In the illustrated embodiment, the fuel tank 19 is disposed toward the bow area of the hull 11, in a forward portion of the engine compartment 15. However, other locations can also be used.

An engine 20 can also be disposed in the engine compartment 15. In the illustrated embodiment, the engine 20 is disposed in approximately a center bottom area of the engine compartment 15. However, other locations can also be used.

The engine 20 can be any type of engine. In the illustrated embodiment, the engine 20 is an in-line, four-cylinder, four-stroke engine. However, this is merely one type of engine that can be used. Other types of engines can be used which operate on other types of combustion principles (e.g., diesel, rotary, two-stroke), have other cylinder configurations (V-type, W-type, horizontally opposed, etc.), and have other numbers of cylinders.

Figure 2:
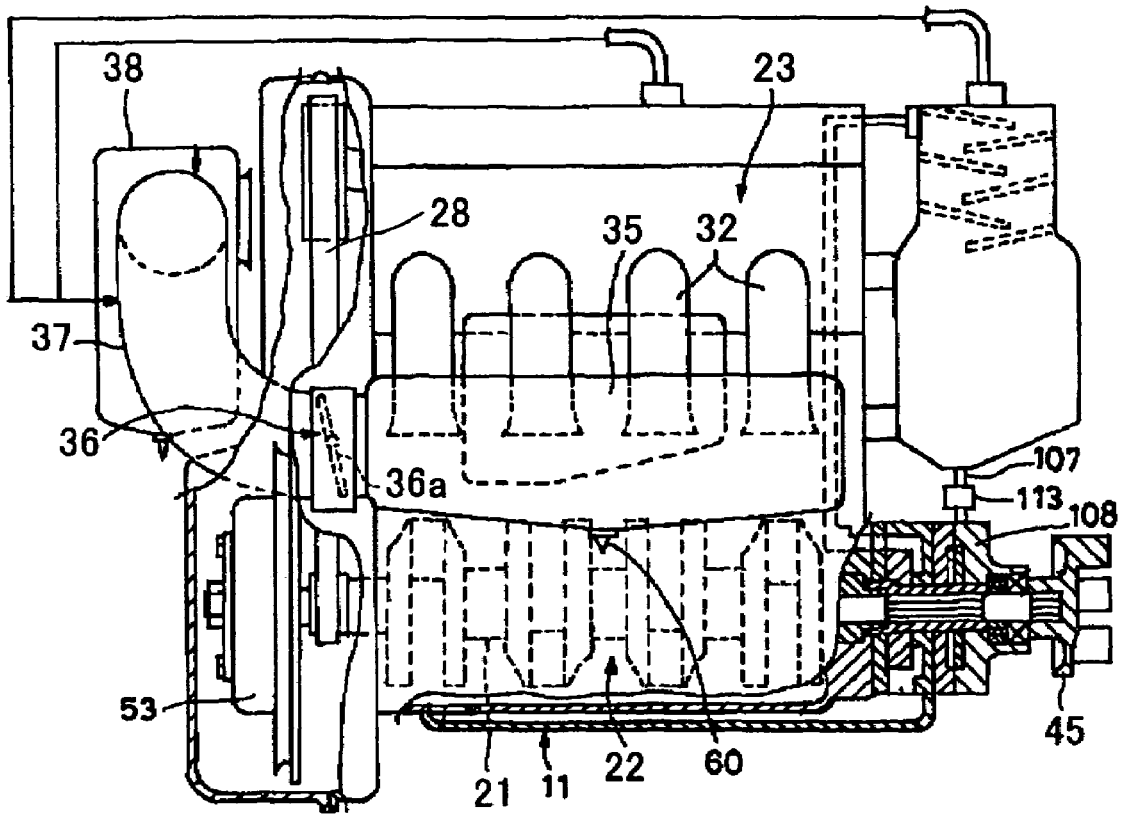
FIG. 2 is a side elevational and partial cutaway view of the engine included in the watercraft of FIG. 1.
Figure 3:
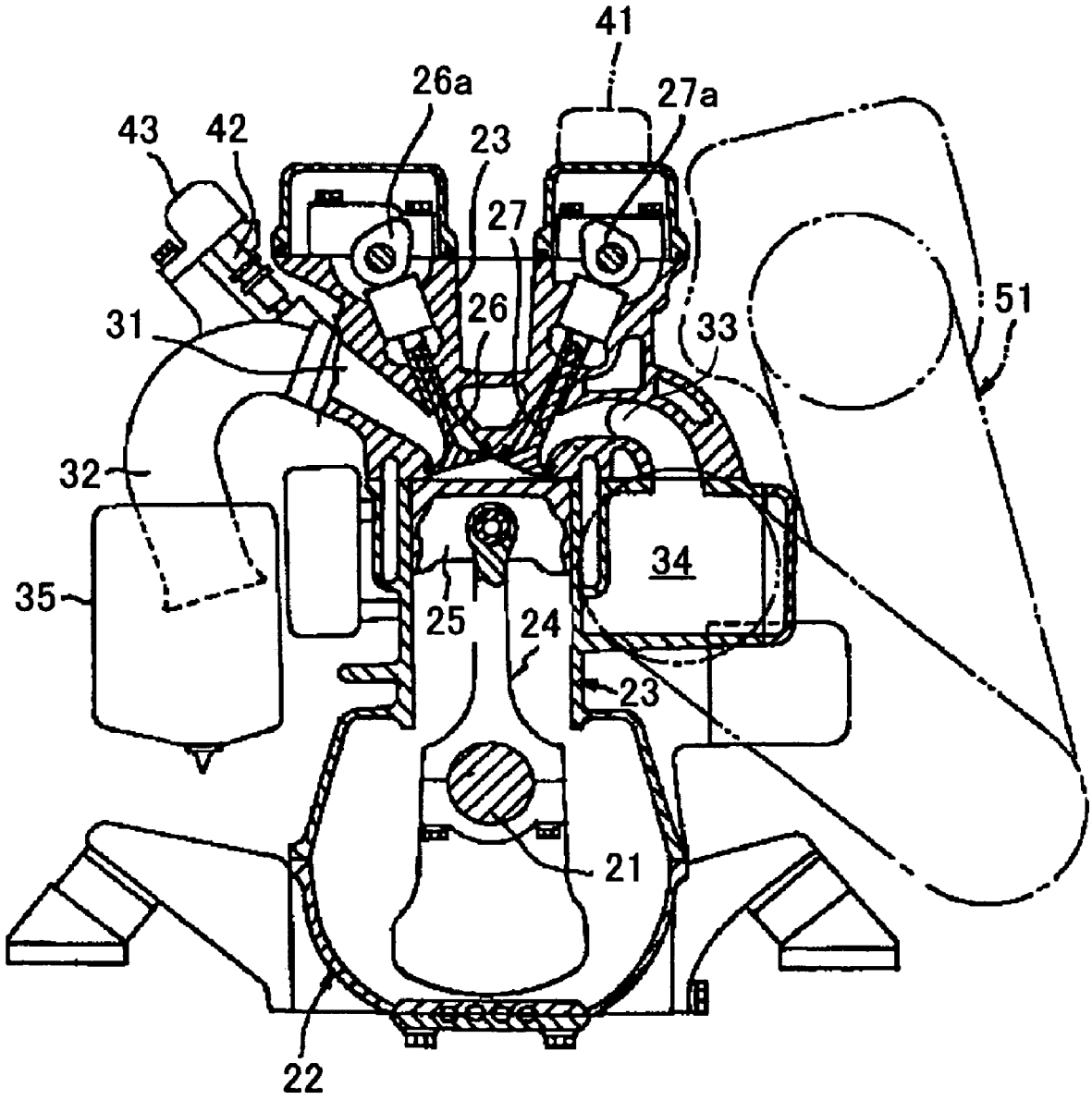
FIG. 3 is a rear elevational and partial sectional view of the engine shown in FIG. 2.

In the illustrated embodiment, as illustrated in FIGS. 2 and 3, the engine 20 includes a crankcase 22. A crankshaft 21 is rotatably journaled within the crankcase 22. Additionally, the engine 20 can include a cylinder assembly 23 disposed above the crankcase 22. Together, the cylinder assembly 23 and the crankcase 22 form an engine body.

The cylinder assembly 23 can include a plurality of cylinder bores. A piston 25 is reciprocally disposed in each of the cylinder bores. The pistons 25 are coupled with the crankshaft 21 through connecting rods 24. The reciprocal movements of the pistons 25 are transmitted to the crankshaft, through the rods 24, and thereby rotate the crankshaft 21.

As noted above, the cylinder assembly 23 includes multiple cylinders. Each cylinder includes one or a plurality of intake valves 26 and one or a plurality of exhaust valves 27. The intake valves 26 and the exhaust valves 27 are driven by an intake camshaft 26*a* and an exhaust camshaft 27*a*, respectively. Both of the camshafts 26*a*, 27*a* are connected to the crankshaft 21 through a camshaft drive mechanism. In the illustrated embodiment, the camshaft drive mechanism comprises a belt 28. However, other types of drive mechanisms can also be used.

In an inlet opening 31 of each intake port is connected to an intake device. The intake device can comprise any type of known induction system configuration. In the illustrated embodiment, the intake device can comprise the intake conduit 32, which is also commonly referred to as an "intake runner." The intake conduit 32 can be connected to the cylinder assembly 23 at its downstream end.

At its upstream end, the intake conduit 32 can be connected to an intake chamber 35. The intake chamber can have any known configuration. Often times, intake chambers such as the intake chamber 35, are referred to as a "silencing device" or "plenum chamber."

With continued reference to FIG. 2, in the illustrated embodiment, the first intake device 35 is connected to another upstream intake chamber 38 with a conduit 37. The intake chamber 38 can also be configured as a silencing device or "plenum chamber."

In some embodiments, a throttle body 36 can be disposed along the conduit 37 between the chambers 35 and 38. However, this is merely one arrangement that can be used for the throttle body 36. For example, the throttle body 36 can be disposed upstream from the chamber 38, or a plurality of throttle bodies 36 can be used wherein one throttle body 36 is disposed along each one of the intake conduits 32.

The throttle body 36 includes a throttle valve 36*a*. The throttle valve 36*a* can be any type of valve. In the illustrated embodiment, the throttle valve 36*a* is a butterfly-type valve. The throttle valve 36*a* is configured, in a known manner, to meter an amount of air flowing through the conduit 37, and thus, meters the amount of air flowing into the engine 20. A pivotal movement of the throttle valve 36*a* between the opened and closed positions adjusts a flow amount of the air supplied to the internal space of the cylinder assembly 23.

The intake chamber 38 includes an inlet configured to allow air from the engine compartment 15 to flow therethrough and into the chamber 38. Thus, air from the atmosphere can flow into the engine compartment 15 through the air duct 17, 18, then into the intake chamber 38.

During operation, ambient air from the atmosphere, flowing the air duct 17, 18, enters the intake chamber 38, then flows through the conduit 37, and into the intake chamber 35. From the intake chamber 35, the ambient air is drawn through the intake conduits 32, past the intake ports 31, and past the intake valve 26 into the cylinder, during the downward movement of the piston 25 on an intake stroke.

Additionally, the cylinder assembly 23 includes exhaust ports for guiding exhaust gases out of the cylinder assembly 23. Each of the exhaust ports extending from the cylinders include an outlet opening 33. Further, each exhaust port includes an exhaust valve 27 for controlling the flow of exhaust gases out of the combustion chambers.

The opening 33 of the exhaust port connects with an upper portion of an exhaust passage 34. In this embodiment, the exhaust passage 34 extends longitudinally along a side surface of the cylinder assembly 23. Thus, the exhaust passage 34 can function as an "exhaust manifold."

The watercraft 10 can also include further exhaust system components for guiding exhaust gases from the exhaust passage 34 to the atmosphere. In the illustrated embodiment, the exhaust system further includes an exhaust conduit 51 extending from the exhaust passage 34 toward the stern end of the watercraft 10. For example, shown in FIG. 1, the exhaust conduit 51 extends rearwardly from the engine 20 and through the bulkhead 14. Within the pump chamber, a "water lock" device is provided. Water lock devices are well known in the art and thus, will not be described in further detail. The exhaust conduit 51 is connected to a forward end of the water lock device 52.

A further exhaust gas pipe 53 extends from a downstream portion of the water lock device 52 in an inverted U-shaped configuration. The downstream end of the exhaust gas pipe 53 is connected to an outlet disposed in a hull tunnel 45*c* formed on a bottom surface of the lower hull section 11*b*. The outlet of the exhaust gas pipe 53 is disposed so as to be generally submerged in the water when the watercraft 10 is operating at idle or low speed in a water displacement mode. Further, the outlet of the exhaust gas pipe 53 is positioned so as to be above the waterline when the watercraft 10 is in a planing mode of operation. However, this exhaust system configuration is merely one type of configuration that can be used with the watercraft 10. Many other types of configurations can also be used.

Figure 4:
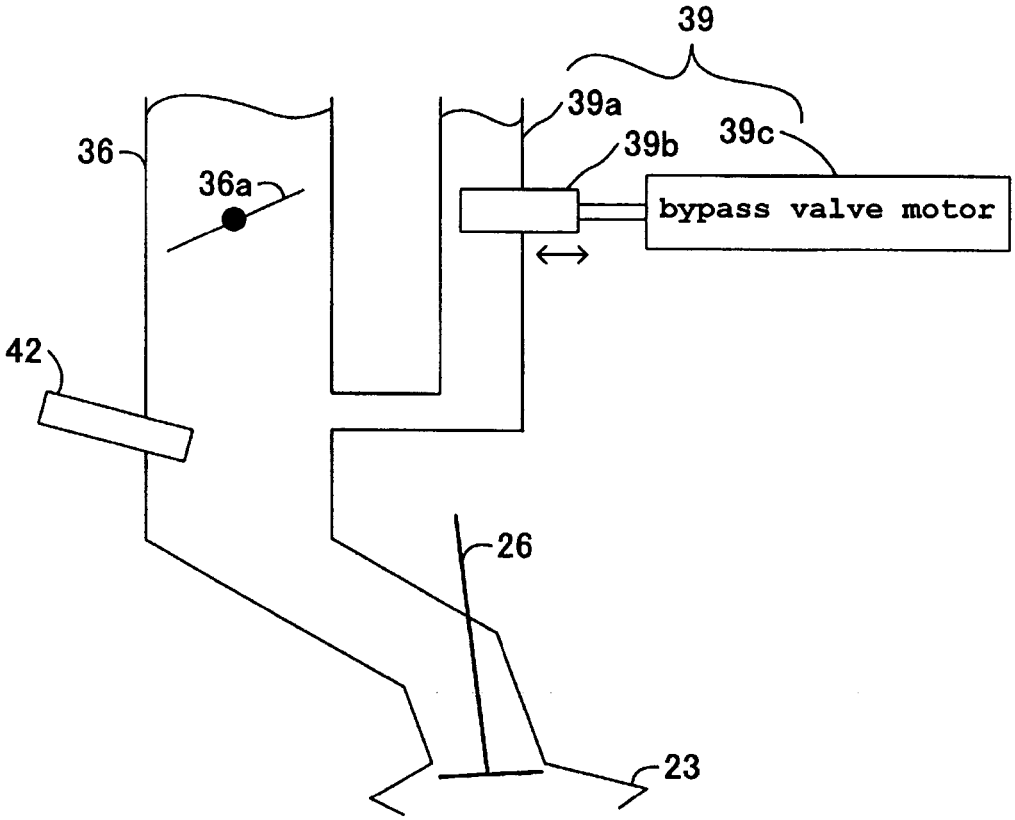
FIG. 4 is a schematic diagram of a portion of an induction system included in the engine of FIGS. 2 and 3, showing the throttle body and an auxiliary air mechanism.

With reference to FIG. 4, the engine 20 can also include an auxiliary air system 39. For example, such an auxiliary air system 39 can be configured to provide for finer control of smaller air amounts flowing to the engine 20. Some known auxiliary air systems allow air to bypass the throttle valve of the engine.

As shown in FIG. 4, the auxiliary air system 39 is configured to bypass the disposed generally adjacent to the throttle body 36. In the illustrated embodiment, the auxiliary air system 39 is disposed generally adjacent to the throttle body 36. The auxiliary air system 39 can comprise an auxiliary intake air conduit 39*a*, an auxiliary intake air valve 39*b*, and an actuator, which is generally referred to herein as a "bypass valve motor" 39*c*.

An upstream end of the auxiliary intake air conduit 39*a* can be in communication with an upstream end of the throttle body 36, or any other part of the induction system upstream from the throttle valve 36*a*. A downstream end of the auxiliary intake air conduit 39*a* communicates with a portion of the induction system downstream from the throttle valve 36*a*, and more specifically, the downstream end of the throttle body 36, however, other configurations can also be used. Thus, air flowing through the auxiliary intake air passage 39*a* can bypass the throttle valve 36*a* and reach the internal space of the cylinder assembly 23.

The bypass valve motor 39*c* can be configured to move or change the orientation of the auxiliary intake air valve 39*b* between open and close positions. During operation, for example, but without limitation, when the throttle valve is closed for idle speed operation, the auxiliary intake air valve 39*b* can be moved to a position to allow sufficient amounts of air to allow the engine to run at idle speed. Additionally, the auxiliary intake air valve 39*b* can be moved to other positions during other modes of operation of the engine 20 to provide other beneficial effects, as is well known in the art.

The engine 20 can also include a fuel supply system. For example, the fuel supply system can be configured to supply fuel from the fuel tank 19 to the engine 20. The fuel system can include a fuel pump 41, a fuel injector 42, a fuel rail 43, as well as other components. With reference to FIG. 3, the fuel pump 41 can be driven with a plunger mechanism operated by one of the camshafts of the engine 20. However, other types of fuel pumps can also be used.

In the illustrated embodiment, the fuel pump 41 draws fuel from the fuel tank 19 and provides pressurized fuel to the fuel rail 43. The pressurized fuel from the fuel rail is delivered to the fuel injector 42 which can be configured to inject a mist into the internal space of the cylinder assembly 23. The timing and duration of each fuel injection event performed by the fuel injector 42 can be performed in any known manner according to any known fuel injection strategy. During operation, the fuel from the fuel injector 42 is mixed with air supplied from the intake system to form an air-fuel mixture in the combustion chamber of the cylinder assemble 23.

The engine 20 can also include an ignition device configured to ignite the air-fuel mixtures in the cylinder assembly 23. For example, the engine 20 can include a spark ignition system having a spark plug with an electrode exposed within the combustion chamber. Such a spark ignition system can cause the ignition of the air-fuel mixture so as to cause the air-fuel mixture to burn and expand and thus cause the pistons 25 to move downwardly within the cylinder bores. The cooperation of the pistons together create a reciprocal motion thereby driving the crankshaft 21.

The watercraft 10 can also include a propulsion device configured to convert power output from the crankshaft 21 of the engine 20 into thrust for propelling the watercraft 10. Any type of propulsion device can be used. In the illustrated embodiment, the watercraft 10 includes a jet pump device 47.

The jet pump device 47 is disposed within the hull tunnel 47*c* and includes an impeller disposed therein. An impeller shaft 46 is coupled with a crankshaft 21 at a forward end thereof with a coupling 45.

A gear reduction device (not shown) can be interposed between impeller shaft 46 and the crankshaft 21 so as to provide a gear ratio other than a one-to-one ratio between the rotation of the crankshaft 21 and the impeller shaft 46. For example, where the engine 20 is a four-stroke engine, it can be advantageous to configure the engine 20 to operate with a maximum engine speed of approximately 10,000 rpm or higher. However, depending on the size and configuration of the jet pump 47, it can be advantageous to limit the maximum speed of the impeller shaft 46 to about 6,000 to 8,000 rpm. Thus, a gear reduction device can be used to allow the engine to rotate at higher engine speeds while limiting the maximum speed of the impeller shaft 46 to lower speeds.

The impeller shaft 46 extends rearwardly through the bulkhead 14 into the jet pump 47. The impeller shaft 46 is coupled to the impeller at its rearward end, which is disposed within the jet pump 47. Thus, the impeller shaft 46 can transmit power from the engine 20 to the impeller. It is to be noted that the impeller shaft 46 can be formed from a single shaft or from multiple shafts. The jet pump 47 includes an opening 47 that opens downwardly from a bottom area of the lower hull section 11*b*. Additionally, the jet pump 47 includes a water jet port 47*b* that opens toward the stern of the hull 11.

The rotation of the impeller causes water to be drawn into the jet pump 47 through the opening 47*a* and to be discharged rearwardly through the discharge port 47*b*. The discharge of water jet from the discharge port 47*b* provides thrust for propelling the watercraft 10 in a forward direction.

The jet pump 47 can also include a steering nozzle 48 attached to the downstream end of the discharge port 47*b*. A diameter of the forward end of the steering nozzle 48 can be slightly larger than the diameter of the rearward end of this steering nozzle 48 can be slightly smaller than the forward end.

The steering nozzle 48 can be pivotally mounted to the discharge port 47*b* so as to allow the steering nozzle to pivot leftward or rightward about a generally vertically extending pivot shaft. The steering nozzle 48 can be connected to the steering device 12 so as to allow an operator to pivot the steering nozzle 48.

Thus, when the operator rotates the steering device 12 clockwise, as viewed in a top plan view, the steering nozzle 48 pivots towards the starboard side. Thus, the watercraft 10 turns toward the starboard side. On the other hand, if the rider rotates the steering device 12 counterclockwise, the steering nozzle 48 pivots toward the port side, causing the watercraft 10 to turn toward the port side.

A reverse gate 49 or "reverse bucket" can be attached to the steering nozzle 48. The reverse gate 49 can be in the shape of a bowl and generally configured to redirect or divert water discharged from the discharge port 47 downwardly and slightly forwardly as to create a reverse thrust for the watercraft 10.

The reverse gate 49 can be attached to both sides of the steering nozzle 48 with a pivot shaft 49*a*. The pivot shaft 49*a* can extend between the centers of the right and left side surfaces of the steering nozzle 48 relative to the vertical direction. The reverse gate 49 thus is pivotable about the generally horizontally extending axis of the pivot shaft 49*a*.

The reverse gate 49 can be connected to a shift lever (not shown) so as to allow an operator to move the reverse gate 49 between a retracted position (illustrated in FIG. 1) and a deployed position in which the reverse gate 49 is rotated downwardly in a clockwise direction (as view in FIG. 1) so as to divert water discharged through the steering nozzle 48. The shift lever can be mounted in the operator's area. For example, the shift lever can be disposed adjacent to an end of the steering device 12.

In operation, when the reverse gate 49 is disposed in the retracted position illustrated in FIG. 1, the watercraft 10 moves forwardly when water is discharged rearwardly through the steering nozzle 48. On the other hand, when the reverse gate 49 is rotated downwardly (clockwise as viewed in FIG. 1), the reverse gate 49 redirects water discharged through the steering nozzle 48 downwardly and slightly forwardly so as to generate a rearward thrust. Thus, the watercraft 10 moves backwardly and can continue to be steered by the operator through operation of the steering device 12.

Figure 5:
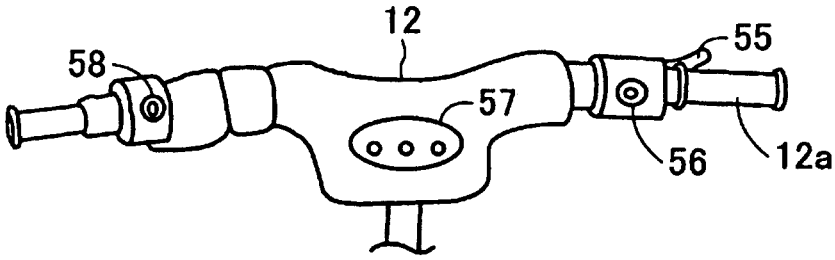
FIG. 5 is a rear elevational view of a handle bar provided on the watercraft of FIG. 1 and including cruise control switches.

With reference to FIG. 5, the steering device 12 can include a power output request device. For example, the steering device 12 can include a lever 55, or another type of input device, conveniently located for an operator to actuate during operation of the watercraft 10. The power output request device can take any form. For example, the power output request device can be in the form of a lever 55 disposed adjacent to a grip 12*a* of the steering assembly 12. The illustrated lever 55 is conveniently located for an operator to actuate the lever 55 with one or more fingers while grasping the grip 12*a*.

Depending on the configuration of the engine 20 and more specifically the method used for controlling the power output of the engine 20, the lever 55 can be connected to a number of different devices. For example, the lever 55 can be directly connected to the throttle valve 36*a* with a cable-type connection, using for example a cable 55*a*. Thus, the throttle valve 36*a* can move in direct proportion to the movement of the lever 55.

In some embodiments, a non-linear control mechanism can be included in the connection between the lever 55 and the throttle valve 36*a*. Such a device can be configured to cause non-linear movements in response to movements of the throttle valve 55. These types of systems are well-known in the art and can be configured such that the power output from the engine 20 is more proportional to angular displacements of the lever 55.

In some embodiments, the lever 55 can be connected to a sensor configured to detect movements of the lever 55 and to generate a signal indicative of the movements of the lever 55. This signal from such a sensor can be used to control an electronic actuator configured to control the position of the throttle valve 36*a*. The sensor can be disposed on the steering assembly and directly connected to the lever 55, or the sensor can be disposed within the engine compartment 15, or other locations. Further, the actuator can be connected directly to the throttle valve 36*a* or can be mounted remotely from the throttle valve 36*a* and connected to the throttle valve 36*a* with a cable or other type of mechanical connection.

However, these are merely some of the examples of the different types of systems that can be used to effect the power output from the engine 20 in response to movements of a power output request device. With continued reference to FIG. 5, the steering device 12 also can include a cruise control switch 56, an information display panel 57, and a stop switch 58. Additionally, a spring (not shown) can be configured to bias the throttle lever to an idle speed position. For example, the idle speed position can be a position in which the lever 55 is spaced away from the grip 12*a*. In this configuration, when the operator pulls the lever 55 toward the grip 12*a*, the throttle valve is moved toward an open position.

The cruise control switch 56 can be used to provide a speed mode change signal, described in greater detail below, so as to allow the watercraft 10 to be changed between cruise control modes, and thus the switch 56 can be referred to as a speed setting operator. For example, but without limitation, such modes can include a regular mode in which the power output of the engine 20 or the speed of the watercraft 10 is changed in proportion to movements of the throttle lever 55 and a speed set mode in which the speed of the watercraft 10 or the speed of the engine 20 is maintained at a desired value. The switch 56 can be a simple push button type actuator or another type of actuator.

In some embodiments, the switch 56, and an associated control system for cruise control operation, can be configured to switch between regular and speed set modes. For example, when the watercraft 10 is operating in regular mode or normal mode, and the switch 56 is depressed, an actuation signal is generated. The actuation signal can be used as a signal for changing the watercraft 10 to a speed set mode. The switch 56 can be released thereby allowing the switch 56 to move in accordance with its bias to off position in which the actuation signal is stopped.

With the watercraft 10 operating in the speed set mode, the switch 56 can again be depressed, thereby causing another actuation signal, which can be used to switch back to regular mode. Again, when the switch 56 is released, the switch 56 moves back in accordance with its bias, which stops the actuation signal. However, this is merely one type of switch arrangement that can be used to control cruise control operations. Other configurations can also be used.

In some embodiments, the information display panel 57 can include an indicator for cruise control operation. For example, but without limitation, the display panel 57 can include an indicator light or other visual or auditory signals for indicating to an operator the status of the speed control operation. In the illustrated embodiment, the panel 57 includes a light that blinks when the speed set mode is active and in which the light is turned off during normal mode operation.

The steering assembly 12 can also include a stop switch 58. In the illustrated embodiment, the stop switch 58 is provided on the port side portion of the steering assembly 12. The stop switch 58 can be configured as a push button type switch, similar to the switch 56. When a stop switch 58 is pushed, the engine 20 is stopped.

For example, a signal from the switch 58 can be used as an indication that the engine should be stopped. The engine can be stopped at any known manner. For example, the fuel system operation can be stopped, the ignition system operation can be stopped, or other measures can be taken to stop the engine. Further, depending on the method used for stopping the engine, it is to be understood that when the action is taken for stopping the engine, such as cutting off fuel and/or ignition, the engine will continue to rotate under its own momentum until the pistons stop reciprocating within the cylinders.

Figure 6:
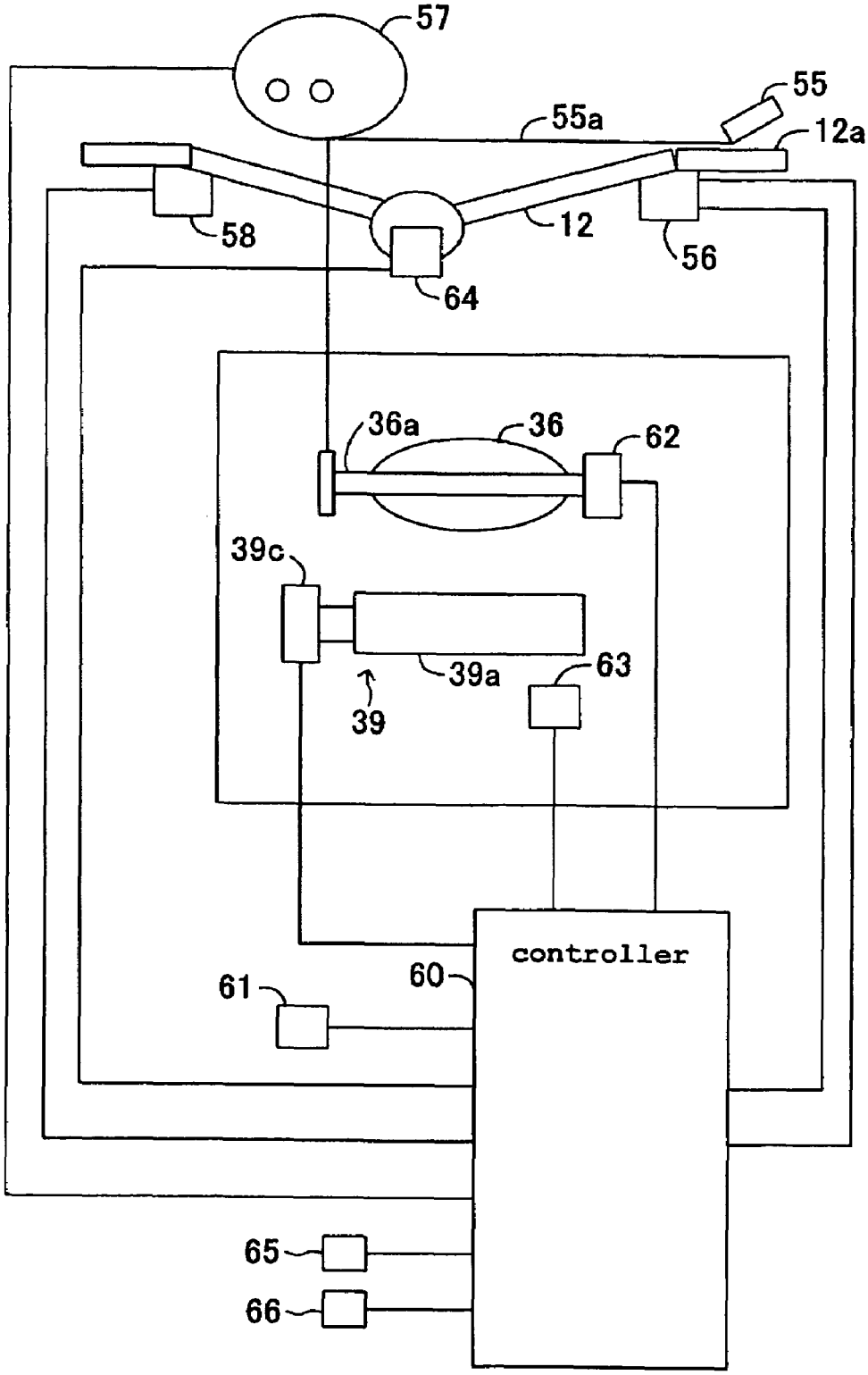
FIG. 6 is a schematic block diagram of devices in the watercraft that can be controlled with a controller.

The watercraft 10 can also include a controller 60 configured to control various operations of the engine 20 and/or other systems. The watercraft 10 can also include sensors, the outputs of which can be used by the controller 60 for control of such systems. For example, but without limitation, the watercraft 10 can include an engine rotational speed sensor 61 configured to serve as an engine rotational speed detecting device, a throttle opening sensor 62 configured to serve as a throttle opening detecting device, an intake pressure sensor 63, a steering load sensor configured to serve as a steering amount detecting device, and a buzzer 65 configured to serve as an informing device. The watercraft 10 can also include a shift switch 66 configured to operate as a shift mechanism, as shown in FIG. 6, in addition to the respective devices described above. Further, the watercraft 10 can also include a start switch (not shown).

The controller 60 can comprise an electrical control device that includes various integrated circuit devices such as a CPU, a RAM, a ROM and a timer. Additionally, the controller 60 can include a speed setting operation detecting module, a speed mode changing module and a speed mode returning module, although other modules can also be used in addition or in lieu of the above-noted modules. The controller 60 can be mounted on a wall surface of the bulkhead 14 that is located in the engine room 15, or other locations.

The controller 60 can be connected to the start switch, the auto cruise switch 56, the stop switch 58, the engine rotational speed sensor 61, the throttle opening sensor 62, the intake pressure sensor 63, the steering load sensor 64 and the shift switch 66 and receives signals sent from those switches and sensors. The start switch can be formed as an ignition switch that starts the engine 20 when turned on by the rider. For example, the start switch can be used to trigger the operation of a starter motor (not shown) for rotating the crankshaft 21 of the engine 20. A rotation signal, from for example, the engine rotational speed sensor 61, can be used as a trigger for starting an operation of the CPU of the controller 60.

The engine rotational speed sensor 61 can be positioned adjacent to the crankshaft 21, or a flywheel (not shown) connected to the crankshaft 21, to detect a rotational speed of the crankshaft 21. The throttle opening sensor 62 can be positioned adjacent to the pivot shaft of the throttle valve 36*a* to detect an opening of the throttle valve 36*a*.

The intake pressure sensor 63 can be positioned adjacent to a portion of the air passage where the throttle body 36 and the auxiliary intake conduit 39*a* merge together. The intake pressure sensor 63 can be configured to detect an intake pressure at a location in the throttle body 36 downstream of the throttle valve 36*a*.

A detection amount of the intake pressure sensor 63 can be indicative of whether or not the intake air amount supplied to the engine 20 is sufficient. The controller 60 can also be configured to control the fuel pump 41 to operate in response to the detection amount of the intake pressure sensor 63 so that the fuel pump 41 supplies an amount of the fuel based upon the intake air amount.

The steering load sensor 64 can be positioned adjacent to a shaft (not shown) that supports a center portion of the steering device 12 for pivotal movement. The steering load sensor 64 can be configured to detect a load applied to the steering device 12 when the steering device 12 is operated, and to output a signal indicate of a load applied to the steering device 12.

The shift switch 66 can be configured to vary its mode of operation in accordance with the operational condition of the shift lever. The controller 60 can be configured to change the speed mode between a condition under which the speed mode is changeable to the speed set mode and another condition under which the speed mode is prohibited from changing to the speed set mode, based upon the mode of the shift switch 66.

The controller 60 can also be connected to the throttle valve 36*a*, the bypass valve motor 39*c*, a liquid crystal display panel 57 and the buzzer 65. The CPU can be configured to execute respective programs stored in the ROM based upon respective signals transmitted from the auto cruise switch 56 and so forth to control the throttle valve 36*a*, the bypass valve motor 39*c*, the liquid crystal display panel 57 and the buzzer 65. The ROM of the controller 60 can also be used to store a speed setting mode program for the auto cruise control under which the watercraft 10 runs with a preset engine rotational speed.

Exemplary operations for running the watercraft 10 and functions of the controller 60 are described below. For example, to begin operation of the watercraft 10, a rider can turn on the start switch. This action can cause the main power of the watercraft systems to be activated, and thus, the watercraft 10 can be ready to run. Afterwards, when the rider operates the shift lever to set the switch 66 to a certain mode, and operates the steering device 12 and operates the throttle lever 55, the watercraft 10 starts running in a regular mode, in a certain direction and in a certain speed in response to the respective operations.

Figure 7:
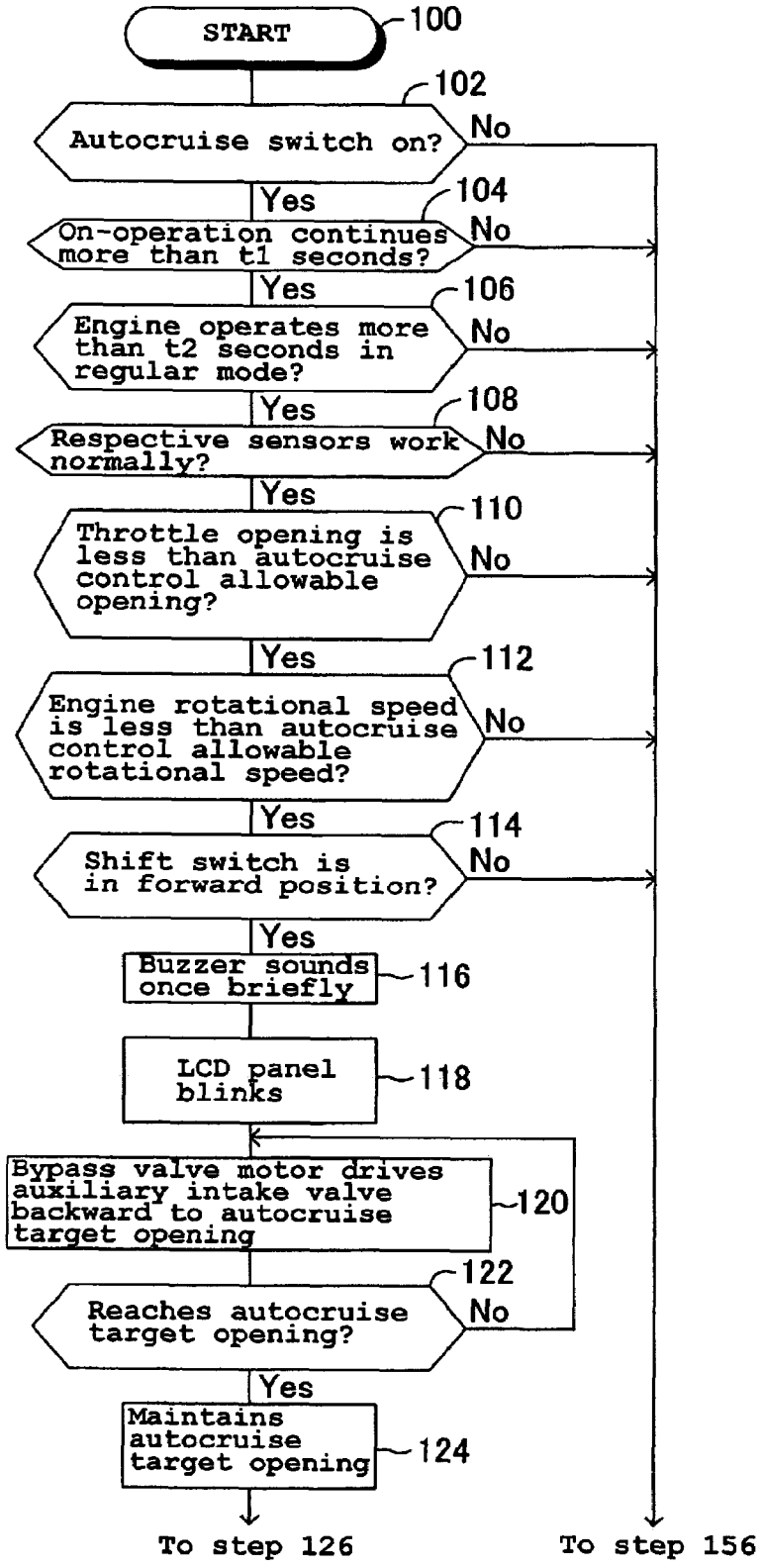
FIG. 7 is a flowchart illustrating a control routine that can be used in conjunction with the watercraft illustrated in FIG. 1.
Figure 8:
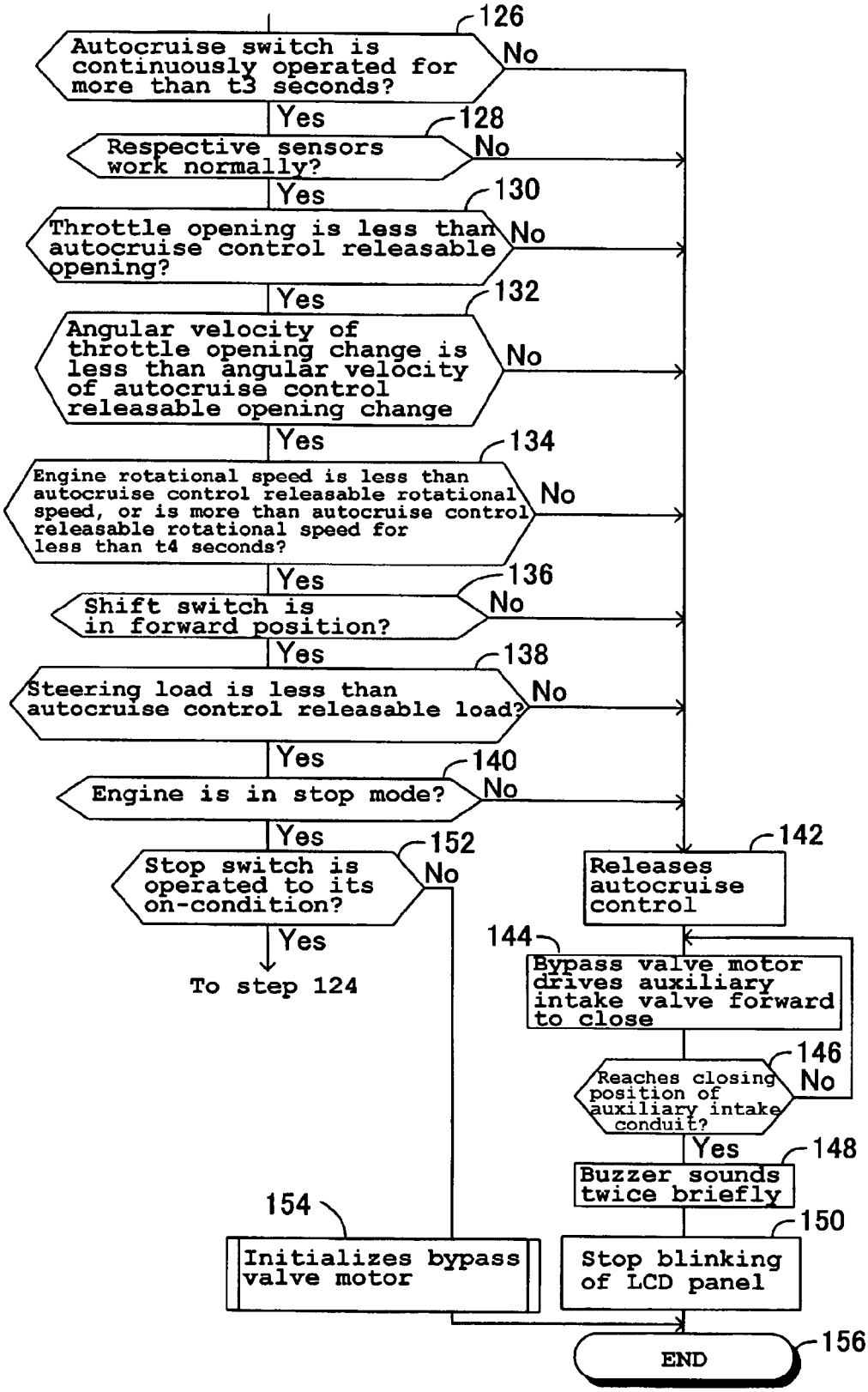
FIG. 8 is an additional part of the flowchart of FIG. 7.

If the rider wants to run the watercraft 10 at a fixed speed within an area such as a shallow water area or an area subject to a speed limit, the rider can stop the operation of the throttle lever 55 to allow the throttle lever to return to the non-operation or idle speed position, and then operate the auto cruise switch 56. Also, upon turning on the start switch, the program illustrated in FIGS. 7 and 8 can be executed and repeated. For example, the program can be repeated at preset time intervals.

The program can be previously prepared and stored in the ROM. Operational conditions of the respective devices furnished to the speed control device for the watercraft 10 vary with the execution of the program as shown in a time chart of FIG. 9. First, the program starts at a step 100 and goes to a step 102. The CPU determines, at the step 102, whether the auto cruise switch 56 is actuated or not. For example, the CPU can sample the output of the switch 56 to determine if the operator is depressing the switch 56.

At this step, if the CPU determines "NO" because the auto cruise switch 56 is not depressed, the program goes to a step 156 to temporarily end and starts again at the step 100. During the execution, the speed mode can be maintained in the regular mode that allows rider's manual operations.

If, on the other hand, the CPU determines "YES" at the step 102 because the auto cruise switch 56 was being depressed, the program goes to a step 104 to determine whether the actuation of the auto cruise switch 56 has continued more than t1 seconds (for example, one second) or not. Thus, this program can require that the auto cruise switch 56 be maintained in a depressed or actuated state for more than t1 second before changing the cruise control mode to the speed set mode from the regular mode.

Thus, for example, if the actuation of the auto cruise switch 56 was unintentional or caused by something other than the rider, and the actuation did not last for more than the t1 time interval, the result of the determination of Step 104 is "NO." Then, the program goes to the step 156 to temporarily stop, and the speed mode can be maintained in the regular mode that allows the rider's manual operations.

If the actuation of the auto cruise switch 56 has continued more than t1 second, the CPU determines "YES" at the step 104, and the program goes to a step 106 to determine whether or not the engine 20 has continued operating for more than t2 seconds (for example, five seconds) in the regular mode.

The delay provided by the step 106 provides time for the engine to reach a stable operational condition before the cruise control mode can be changed. In this embodiment, the program waits until the engine has been running for at least t2 seconds elapses after the engine operation had started in the regular mode, and prohibits the speed mode from being changed to the speed set mode before the time t2 elapses. If the engine 20 has not continued operating in the regular mode for t2 seconds, the CPU determines "NO" in the step 106, and the program goes to the step 156 to temporarily end, and the speed mode can be maintained in the regular mode that allows the rider's manual operations.

If, on the other hand, the engine 20 has continued operating in the regular mode for more than t2 seconds, and the CPU determines "YES" in the step 106, the program goes to a step 108 to determine whether all the signals sent from the respective sensors, including the engine rotational speed sensor 61, the throttle opening sensor 62, the intake pressure sensor 63 and the steering load sensor 64, are normally received or not.

Thus, this program can prohibit the cruise control from being changed to the speed set mode unless the controller 60 normally receives the signals from the respective sensors. Without these signals, the controller 60 cannot make an appropriate control in the speed set mode under this condition. If the controller 60 cannot normally receive the signals from the respective sensors and so forth due to breakdown, short-circuit, or other faults, the CPU determines "NO" in the step 108, the program goes to the step 156 to temporarily end, and the speed mode can be maintained in the regular mode that allows the rider's manual operations.

If the controller 60 normally receives the signals from the respective sensors and so forth, and the CPU determines "YES," the program goes to a step 110 to determine whether or not the throttle opening can be smaller than an auto cruise control allowable opening.

The auto cruise control allowable opening can be predetermined to be "zero" with which the throttle valve 36*a* can be positioned at the fully closed position. That is, in the speed set mode, the air can be supplied to the cylinder assembly 23 under the condition that the throttle valve 36*a* can be placed at an idle speed position which can be fully closed position or almost fully closed position.

As such, the controller 60 can be configured to activate the bypass valve motor 39*c* to reciprocally displace the auxiliary intake valve 39*b*. The reciprocal displacement of the auxiliary intake valve 39*b* opens or closes the internal passage of the auxiliary intake conduit 39*a* to adjust the amount of the air to be supplied. At this step, if the throttle opening becomes greater than the auto cruise control allowable opening and the CPU determines "NO," the program goes to the step 156 to temporarily end, and the speed mode can be maintained in the regular mode that allows the rider's manual operations.

If the throttle opening is less than the auto cruise control allowable opening, then the CPU determines "YES," and the program goes to the step 112 to determine whether or not the engine rotational speed is less than the auto cruise control allowable rotational speed.

The auto cruise control allowable rotational speed can be an engine speed configured to inhibit the engine rotational speed from abruptly increasing at the moment of the change of the speed mode. Under the condition that the engine rotational speed can be greater than the auto cruise control allowable rotational speed, the speed mode can be prohibited from changing to the speed set mode from the regular mode. If the engine speed exceeds the auto cruise control rotational speed, then the CPU determines "NO" at the step 112, and the program 156 goes to the step 156 to temporarily end. The speed mode can be maintained in the regular mode that allows the rider's manual operations.

If the engine speed is less than the auto cruise control rotational speed, then the CPU determines "YES," and the program goes to a step 114. At the step 114, the CPU determines whether or not the shift switch 66 is placed in the forward position or not. Often times, operators of boats like the watercraft 10 (which include a cruise control system) almost exclusively use the auto cruise control when the boats are run forward at a fixed speed for a relatively long period of time. Such boats are not usually operated with the auto cruise control during reversing. Thus, in this watercraft 10, the program can be configured such that the speed set mode can be used only under a forward moving condition. Under the backward moving condition ("reversing"), only the regular mode is available.

If the shift switch 66 is placed in the reverse position, then the CPU determines "NO" at the step 114, and the program goes to the step 156 to temporarily end. The speed mode is maintained in the regular mode and thus allows the rider's manual operations.

Figure 9:
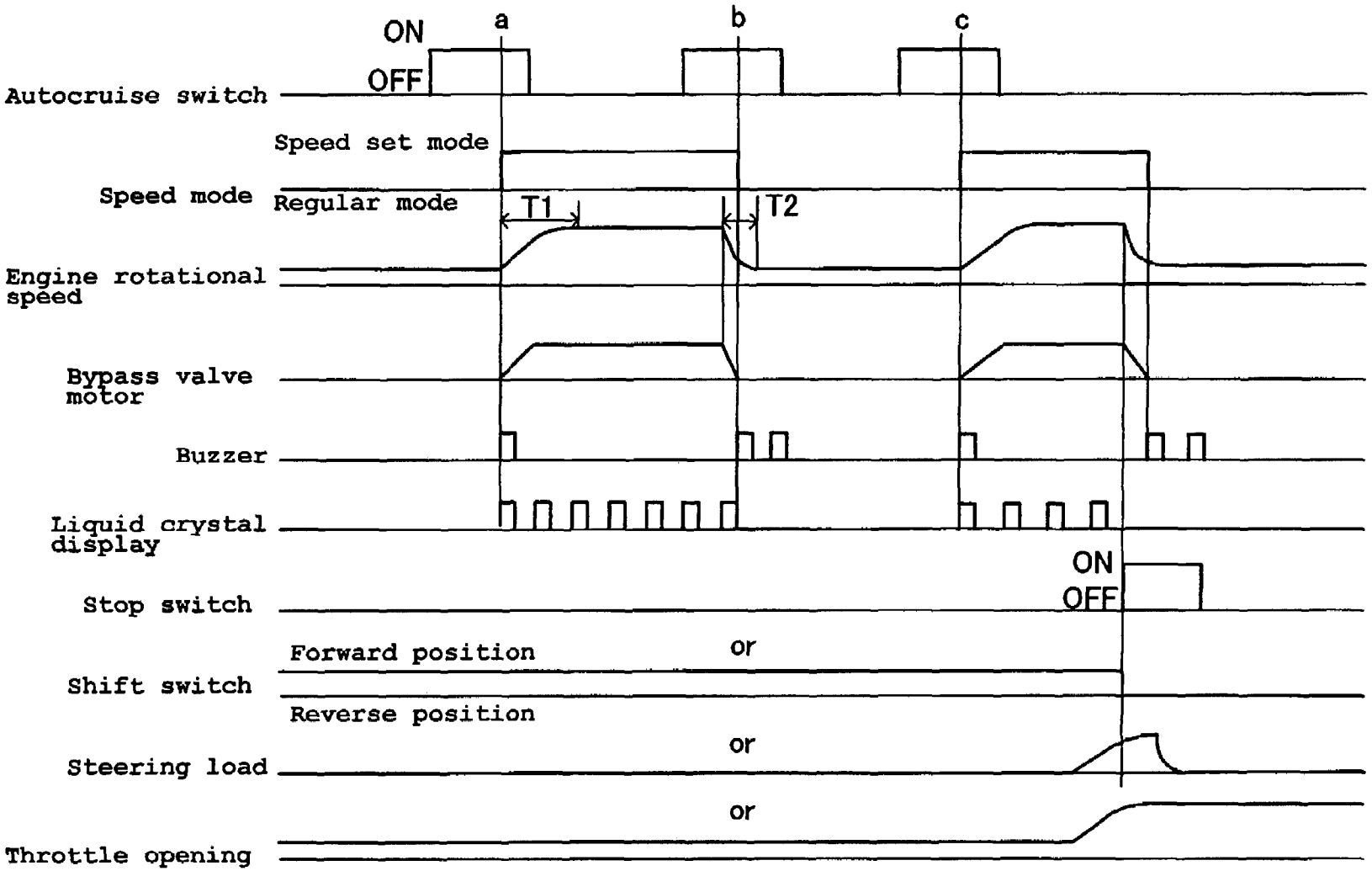
FIG. 9 is a timing diagram illustrating exemplary operations of the watercraft.

If the shift switch 66 is placed in the forward position, then the CPU determines "YES," and the program goes to a step 116 to sound the buzzer. For example, the buzzer can be sounded only once briefly as shown in FIG. 9. The program can then goes to a step 118 to initiate the blinking of a certain portion of the liquid crystal display panel 57. Thereby, the rider becomes aware of a change in the drive mode to the speed set mode from the regular mode. Then, the program goes to a step 120.

At the step 120, the CPU can perform a process in which the bypass valve motor 39*c* drives the auxiliary intake valve 39*b* backward so that the internal passage of the auxiliary intake conduit 39*a* can be gradually opened from the fully closed condition. Next, at a step 122, the CPU can determine whether or not the opening of the auxiliary intake conduit 39*a* reaches a preset auto cruise target opening. This determination can be made based upon the detection amount of the intake pressure sensor 63. If the opening has not yet reached the auto cruise target opening, the CPU determines "NO," and the program goes to the step 120. The controller 60, at the step 120, again controls the bypass valve motor 39*c* to actuate the auxiliary intake valve 39*b* backward.

The process at the steps 120 and 122 can be repeated until the opening of the auxiliary intake conduit 39*a* reaches the auto cruise target opening. In this program, a time T1 (see FIG. 9) can be decided to continue for three or four seconds. That is, the time T1 can be the time that ranges between a starting moment of the process of the step 116 and a moment at which the engine operational speed reaches the preset value after the opening of the auxiliary intake conduit 39*a* reaches the auto cruise target opening.

If the opening of the auxiliary intake conduit 39*a* reaches the auto cruise target opening, then the CPU determines "YES" at the step 122, and the program goes to a step 124. At the step 124, the CPU can control the bypass valve motor 39*c* to maintain the opening of the auxiliary intake conduit 39*a* in the auto cruise target opening. Thus, the engine 20 operates in a fixed rotational speed corresponding to the auto cruise target opening of the auxiliary intake conduit 39*a*, and the watercraft 10 runs forward at a generally fixed speed. The running of the watercraft 10 in the speed set mode continues until respective operations for returning the speed mode to the regular mode, which will be described later, are made (between the moment a and the moment b of FIG. 9).

Next, the program goes to a step 126 (FIG. 8), and the CPU of the controller 60 determines, at the step 126, whether or not the auto cruise switch 56 has been continuously operated for more than t3 seconds (for example, 0.5 seconds). If the auto cruise switch 56 was not actuated, or was actuated for less than t3 seconds, then the CPU determines "YES" at the step 126. The program maintains the speed set mode in this state and goes to a step 128. If the auto cruise switch 56 was actuated for more than t3 seconds, then the CPU determines "NO" at the step 126, and the program goes to a step 142. Afterwards, the CPU can perform a process in which the speed mode is changed to the regular mode from the speed set mode. This process will be described later.

A time required for the determination that the speed mode can be changed to the regular mode from the speed set mode needs to continue more than the t3 seconds similarly to the time t1 for the determination that the speed mode is changed to the speed set mode from the regular mode. In this manner, the CPU can better recognize that the operation is made in accordance with the intention of the rider. In this embodiment, the time t3 is shorter than the time t1. Thus, the return to the regular mode from the speed set mode can be made more readily than the change to the speed mode from the regular mode.

At the step 128, the CPU can determine whether the controller 60 receives signals from the respective sensors, including the engine rotational speed sensor 61, the throttle opening sensor 62, the intake pressure sensor 63 and the steering load sensor 64, similarly to the process at the step 108. If the respective sensors or the like work normally, then the CPU determines "YES" at the step 128 and the program goes to a step 130 with the speed set mode maintained. If the respective sensors or the like do not work normally, then the CPU determines "NO" at the step 128, the program goes to a step 142.

At the step 130, the CPU can determine whether or not the throttle opening is less than an auto cruise control releasable opening. This auto cruise control release opening can be a reference opening to release the speed set mode. In some embodiments, this value can be the same value as the auto cruise control allowable opening used at the step 110. Alternatively, the auto cruise control releasable opening can have a value different from the auto cruise control allowable opening. In some embodiments, the auto cruise control releasable opening can be "zero" at which the throttle valve 36*a* can be fully closed. If the throttle opening is less than the auto cruise releasable opening, then the CPU determines "YES" at the step 130, and the program goes to the step 132 with the speed set mode maintained. If the throttle opening is greater than the auto cruise releasable opening, then the CPU determines "NO," and the program goes to a step 142.

At the step 132, the CPU determines whether or not a change angular velocity of the throttle opening is less than a change angular velocity of the auto cruise control releasable opening. The auto cruise control releasable opening change angular velocity in this embodiment can be a predetermined reference to release the speed set mode. In some embodiments, cruise control releasable opening change angular velocity can be a preset amount based upon a change of an angle of the throttle opening per second. If the change angular velocity of the throttle opening is less than the auto cruise control releasable opening change angular velocity, then the CPU determines "YES" at the step 132, and the program goes to a step 134 with the speed set mode maintained. If the change angular velocity of the throttle opening is greater than the auto cruise control releasable opening change angular velocity, then the CPU determines "NO," and the program goes to a step 142.

At the step 134, the CPU can determine whether the engine rotational speed is less than an auto cruise control releasable rotational speed, and whether a condition under which the engine rotational speed is less than the auto cruise control releasable rotational speed continues for more than t4 seconds (for example, three seconds). The auto cruise control releasable rotational speed in this embodiment can be a reference value for releasing the speed set mode. Thus, auto cruise control releasable rotational speed can be set to a value that is the same as the amount of the auto cruise control allowable rotational speed used at the step 112, or value that is different from the value of the auto cruise control allowable rotational speed.

If the engine rotational speed is less than the auto cruise control releasable rotational speed, or if the engine rotational speed is greater than the auto cruise control releasable rotational speed for a time period less than t4 seconds, then the CPU determines "YES" at the step 134. On this occasion, the program goes to a step 136 with the speed set mode maintained. If the engine rotational speed becomes greater than the auto cruise control releasable rotational speed and further this condition has continued more than t4 seconds, then the CPU determines "NO" and the program goes to the step 142.

At the step 136, the CPU can determine whether the shift switch 66 is placed in the forward position or not. If the shift switch 66 is kept in the forward position, then the CPU determines "YES" at the step 136, and the program goes to a step 138 with the speed set mode maintained. If the rider operates the shift switch 66 to the reverse position, then the CPU determines "NO," and the program goes to the step 142.

At the step 138, the CPU can determine whether a detection amount of the steering load sensor 64 is less than an auto cruise control releasable load. This auto cruise control releasable load can be a reference load for releasing the speed set mode. Thus, the program returns to the regular mode from the speed set mode when the rider rotates the steering device 12 and the steering load applied to the steering device 12 exceeds the auto cruise control releasable load. Thus, in this embodiment, all the rider needs to do is to rotate the steering device 12 slightly greater than its usual movement for the speed mode to return to the regular mode from the speed set mode. In other words, the rider does not need to push the auto cruise switch 56.

The auto cruise control releasable load can be set to be a steering load that is produced when the steering device further receives rotational force under a condition that the steering device has been already moved to the right or left limit position. If a detection load of the steering load sensor 64 is less than the auto cruise control releasable load, then the CPU determines "YES" at the step 140, and the program goes to a step 140 with the speed set mode maintained. If the detection amount of the steering load sensor 64 becomes greater than the auto cruise control releasable load, then the CPU determines "NO," and the program goes to the step 142.

At the step 140, the CPU can determine whether the engine 20 is in a stop mode or not. This stop mode of the engine 20 is decided based upon a condition, as a reference, that the rotational speed of the engine 20 becomes "zero" or becomes less than a preset amount that is less than an idle speed and/or is nearly "zero." If the rotational speed of the engine 20 is greater than the preset value and does not reach the speed to set the engine stop mode, then the CPU determines "YES" at the step 140 and the program goes to a step 152 with the speed set mode maintained. If, on the other hand, the rotational speed of the engine 20 is less than the preset value and has reached the speed to set the engine stop mode, then the CPU determines "NO" and the program goes to the step 142.

Next, the processes at steps, including the step 142, when the CPU determines "NO" in the processes at the steps 126, 128, 130, 132, 134, 136, 138 and 140 are described. At the step 142, the process for releasing the auto cruise control is conducted to return the speed mode to the regular mode from the speed set mode as shown in an area of the time b of FIG. 9. Then, the program goes to a step 144, and the CPU actuates the bypass valve motor 39*c* to close the internal passage of the auxiliary intake conduit 39*a*, which has been opened to the auto cruise target opening. Next, at a step 146, the CPU determines whether or not the internal passage of the auxiliary intake conduit 39 has been fully closed.

This determination is made based upon a command signal that is given to the bypass valve motor 39*c*. If the internal passage of the auxiliary intake conduit 39*a* has not been fully closed yet, then the CPU determines "NO," and the program goes to the step 144. The controller 60 again controls the bypass valve motor 39*c* to actuate the auxiliary intake valve 39*b* forward.

The processes at the steps 144, 146 repeat until the internal passage of the auxiliary intake conduit 39*a* is fully closed. In this program, a drive speed of the bypass valve motor 39*c* to fully close the internal passage of the auxiliary intake conduit 39*a* can be the maximum speed of the motor 39*c*, although other speeds can also be used. Thus, a time T2 (see FIG. 9) beginning at the moment at which the bypass valve motor 39*c* starts operating after the process at the step 142 and ending at a moment at which the engine rotational speed reaches a preset amount in the regular mode, can be about 0.5 seconds.

When the internal passage of the auxiliary intake conduit 39*a* is fully closed, then the CPU determines "YES" at the step 146, and the program goes to a step 148 to sound the buzzer 65 twice briefly. However, other indicators can also be used. The program then goes to a step 150 to stop the blinking of a certain portion of the liquid crystal display panel 57. The rider thus can recognize that the drive mode has returned to the regular mode from the speed set mode. The program then goes to a step 156 to end.

If the CPU determines "YES" at the step 140 in the program, and thus the program goes to the step 152 with the speed set mode maintained, the CPU determines, at the step 152, whether the stop switch 58 is operated or not. If the stop switch 58 is not operated, then the CPU determines "YES" at the step 152, and the program goes to the step 124 to maintain the speed set mode that is based upon the auto cruise target opening. Then, the processes following the step 126 described above are conducted in sequence.

If the stop switch 58 is operated, then the CPU determines "NO" at the step 152, and the program goes to a step 154. At the step 154, the CPU can perform a process to initialize the bypass valve motor 39*c*. In this embodiment, the bypass valve motor 39*c* can be initialized whenever the stop switch 58 is operated to stop the engine 20. On this occasion, the auxiliary intake valve 39*b* coupled with the bypass valve motor 39*c* once moves to a position where the internal passage of the auxiliary intake conduit 39*a* is fully opened and then moves to another position where the passage is fully closed.

When the initialization process of the bypass valve motor 39*c* at the step 154 completes, the program goes to a step 156 to end. Also, the determinations at the steps 130, 132 and 138 can be applied as final determinations when the same determinations in the main routine are obtained multiple times such as three to five times without a break, to thereby assure reliability of the determinations. Also, if the auto cruise switch 56 is operated to turn on after a certain period of time elapses, the speed mode is again changed to the speed set mode from the regular mode t1 seconds later (time c shown in FIG. 9).

Also, in the watercraft 10 in some embodiments, ignition timing and fuel injection parameters can be controlled based upon predetermined control maps. Such maps can be used to control the ignition timing, the fuel injection amount and timing and so forth during the time period in which the speed mode is set to the speed set mode, based upon respective amounts which are obtained on adjustment of corresponding amounts in the regular mode using a certain manner.

Figure 10:
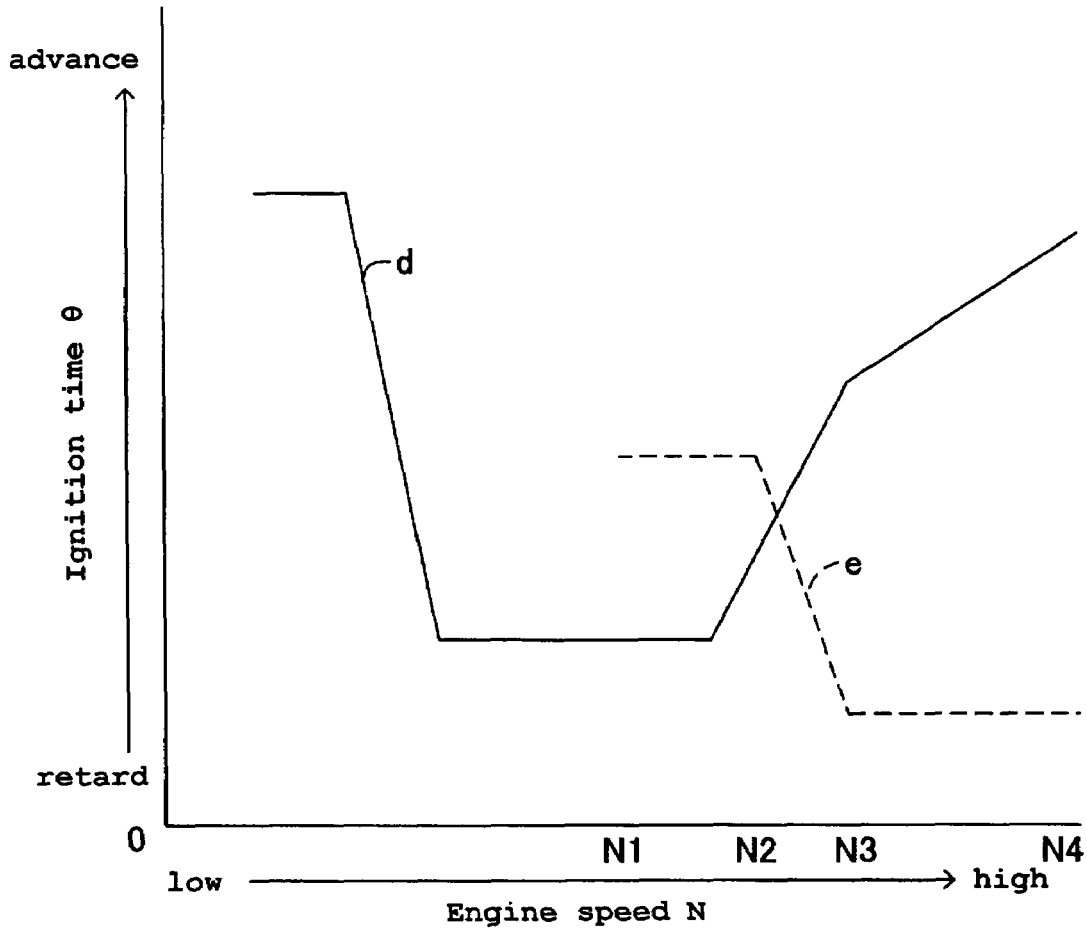
FIG. 10 is a graph showing exemplary relationships between engine speed and ignition timing.

FIG. 10 shows exemplary relationships between the ignition timing θ versus the engine speed N. The solid line d represents an exemplary ignition timing in the regular mode. The dotted line e represents an exemplary ignition timing in the speed set mode. The minimum point "zero" in the vertical axis of the ignition timing θ corresponds to the top dead center. The angle (e.g. the number of crank degrees) before the top dead center becomes larger with a point on the vertical axis going upward in the graph (more spark advance). Also, the engine speed N becomes larger with a point on the horizontal axis going rightward in the graph.

Although the ignition timing θ is not fixed and changes in accordance with respective conditions such as the engine speed, an intake air temperature, a cooling water temperature, an air/fuel ratio and so forth, the graph shows a relationship only with the engine speed N. Also, a target of the engine speed N in the speed set mode is given between the engine speed N2 and the engine speed N3 of FIG. 10. The control in the speed set mode starts when the engine speed exceeds the speed N1 and is maintained until the engine speed reaches the speed N4.

Further, a portion of the line d of FIG. 10, which represents the regular mode, around the engine speed N1 corresponds to an idle speed range. The line d is given such that the ignition timing θ advances (the angle from the top dead center becomes larger) in proportion to the increase of the engine speed N in the regular mode. However, the engine speed N is apt to fluctuate as the ignition timing θ advances. Because of this, in the speed set mode represented by the dotted line e, the CPU retards the ignition time θ (the angle becomes smaller) to approach the top dead center so that the fluctuation of the engine speed N decreases and the operation of the engine 20 can be more stable.

Table 1 below shows exemplary correction coefficients that can be used for control of the fuel injection amounts in the speed set mode. In some embodiments, a larger air/fuel ratio (leaner) can be used to make the air/fuel mixture leaner under conditions where both of the engine speed N and the ignition timing θ are fixed. A knocking, however, is can occur when lean air/fuel mixtures are combusted. Also, if the watercraft 10 is suddenly accelerated or in similar situations, the intake air amount can abruptly increase. However, the fuel amounts injected by the fuel system might not increase as quickly as the air amounts, and thus, the fuel amounts increase more slowly. Thus, the air/fuel ratio can temporarily shift toward leaner mixtures. In addition, as the fuel amounts increase in response to the increasing air amounts, the fuel amounts can become excessive and thereby make the engine speed or power output of the engine fluctuate.

TABLE 1

| Engine speed (rpm) | Correction coefficient |
|---|---|
| N1 | 1 |
| N2 | 0.75 |
| N3 | 0.74 |
| N4 | 1.1 |

Thus, a smaller air/fuel ratio (i.e., richer) can be used to make the air/fuel mixture richer in the regular mode. However, during operation in the speed set mode, leaner (and thus more fuel efficient) air/fuel mixtures can be used because the watercraft 10 runs in a fixed speed without sudden accelerations or decelerations. As shown in Table 1, exemplary correction coefficients can be applied for these respective situations. For example, correction coefficients 1, 0.75, 0.74 and 1.1 can be given in accordance with the engine speeds N1, N2, N3 and N4, respectively. Each fuel amount in the speed set mode can be calculated by multiplying each fuel injection amount given in the regular mode by the respective correction coefficient. These exemplary fuel amounts can inhibit the fluctuation of the engine speed to realize a more stable running of the engine 20 and thus can contribute to a reduction of fuel consumption.

As described above, the auto cruise switch 56 can be formed as a pushbutton switch unit having a spring that biases the switch to return to an un-actuated state. When a rider operates the auto cruise switch 56 (i.e., actuates the switch by a pressing action) and keeps the switch 56 in this state for a preset time, the speed mode of the engine 20 can be changed to the speed set mode in which the cruise control operation is performed. Under this condition, when the rider again operates the switch 56 and keeps the switch 56 in this state for a preset time, the speed mode can return to the regular mode that allows the rider to control the speed of the watercraft 10 or the power output of the engine 20 manually. Additionally, the watercraft 10 can b configured such that if the engine operation stops or nearly stops, the speed mode can return to the regular mode from the speed set mode.

Thus, when the operator brings the watercraft 10 to its standstill state and stops the engine operation, the cruise control mode changes to the regular mode in which the auto cruise control operation is released. As a result, when the engine 20 is started again, the fuel injection amount is prevented from increasing simultaneously with the start of the engine 20. Further, the speed mode is allowed to change to the speed set mode from the regular mode only when the operational condition of the auto cruise switch 56 is changed to the speed set mode from the regular mode. Thus, the speed set mode is not activated without the rider's intention to do so, and the unintentional change to the speed set mode can be prevented.

In order to return the cruise control mode to the regular mode from the speed set mode, the rider can operate the stop switch 58, operate the shift lever to set the shift switch 66, operate the steering device 12 or operate the throttle lever 55 as shown in FIG. 9, without the need for operating the auto cruise switch 56. Thus, if the rider wants the watercraft 10 to operate the watercraft 10 in the regular mode after running in the speed set mode, the rider can simply operate one of the shift lever, the steering device 12, and the throttle lever, to change the cruise control mode to the regular mode without operating the auto cruise switch 56. The change to the regular mode is thus more simple.

In some embodiments, the time T1 is sufficiently long such that the engine rotational speed can change smoothly to a preset value during the change to the speed set mode from the regular mode. Thus, the rider can enjoy a smoother and more comfortable ride. Also, even though the engine rotational speed can fall to idle speed operation during the change to the regular mode from the speed set mode, the running speed of the watercraft 10 does not change suddenly because the boat 10 has the inertia.

As noted above, in some embodiments, the watercraft 10 includes a notification device that includes the buzzer 65 and the liquid crystal display panel 57. The rider thus can easily recognize the change of the speed mode by the sound and the blinking of the light. Further, in some embodiments, the fuel injection amount supplied to the engine 20 and the ignition timing for the fuel in the engine 20 can be adjusted when the speed mode is in the speed set mode. Thus, the operational conditions of the engine in the speed set mode can be more stable and sufficient, and the fuel consumption can be also reduced.

Figure 11:
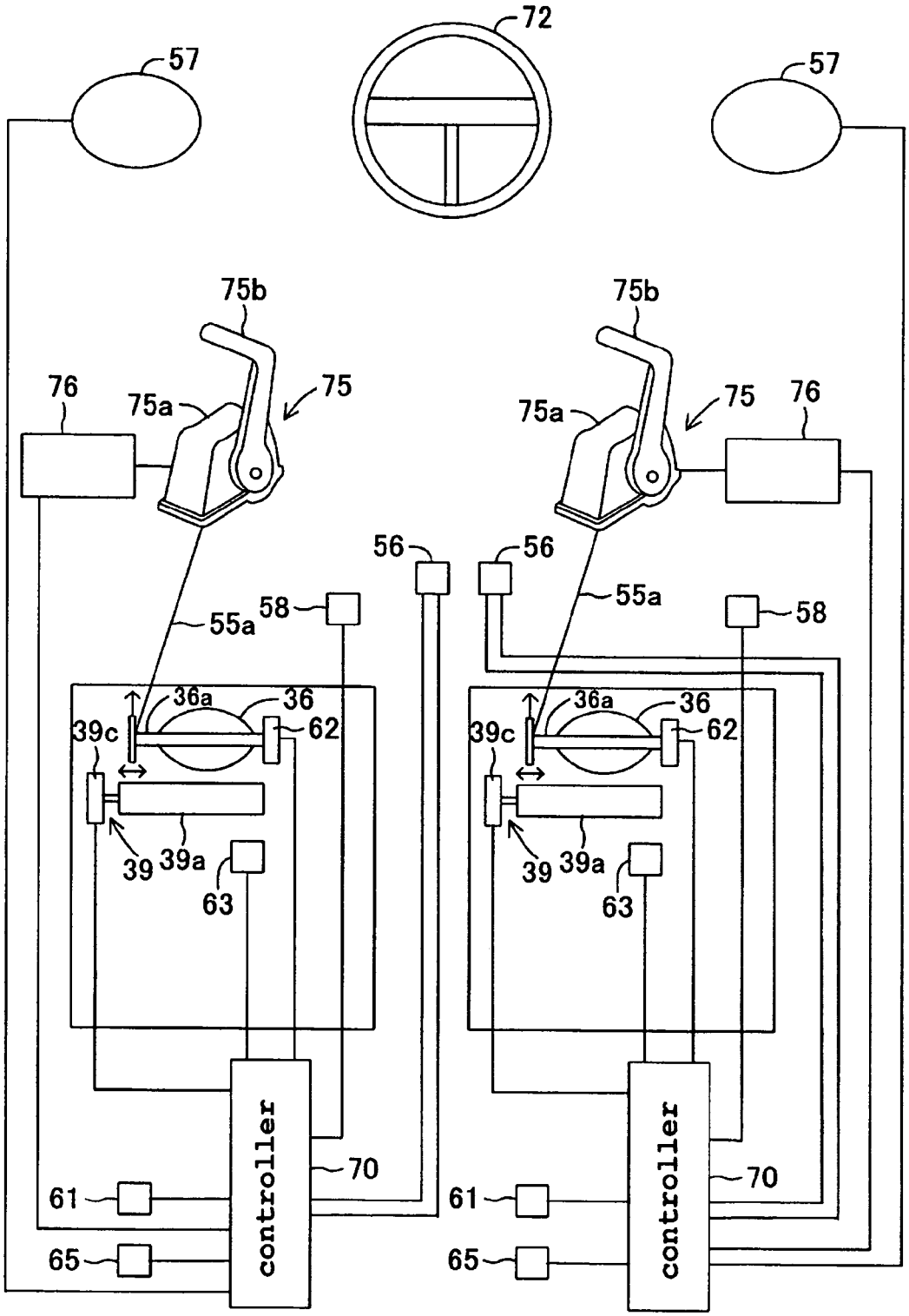
FIG. 11 is another block diagram illustrating control systems for a watercraft in accordance with another embodiment.

FIG. 11 illustrates a speed control device for a water jet propulsion boat having at least two propulsion units. In the illustrated embodiment, the boat has two sets of engines and propulsion devices (not shown) to generate a propulsive force. In these types of boats, the boat can be operated even when one propulsion unit malfunctions. Further, the components and systems of each of the propulsion units described below with reference to FIG. 11 can be assumed to be the same or similar to those described above with reference to the propulsion unit illustrated in FIGS. 1-10, except as noted below. Thus, the description of those components and systems is not repeated below.

With continued reference to FIG. 11, the speed control device for the illustrated boat comprises a pair of devices such as the controllers 70, that control each rotational speed of the respective engines. The respective controllers 70 are constructed to independently control the associated engines.

The boat can have a circular steering device 72 or a bar-shaped steering device 12 (FIG. 1). The steering device 72 can be coupled with the steering nozzles (not shown) of both f the propulsion units. Thus, a pivotal movement of the steering device 72 changes the direction of the steering nozzles rightward or leftward. For example, a clockwise movement of the steering device 72 (in plan view) causes the boat to turn rightward. On the other hand, a counterclockwise movement of the steering device 72 causes the boat to turn leftward. In the illustrated embodiment, the steering device 72 does not include a sensor for detecting the steering load, however, such a sensor can be included.

The boat can have a pair of operational levers 75 that can serve as power output request devices as well as shift levers. Each operational lever 75 can be coupled with a body 75*a* for pivotal movement about an axis defined by a coupling portion between the body 75*a* and the lever 75. Such a coupling portion can be configured to allow the levers 75 to pivot about the axis in generally forward and backward directions. With a movement of the operational lever 75 toward its forward limit, the boat moves forward at a speed that corresponds roughly to the position of the lever 75. Also, with a movement of the operational lever 75 toward its backward limit, the boat moves backward at a speed that corresponds roughly to the position of the lever 75. Further, with a movement of the operational lever 75 toward a center portion between the forward and backward limits, the boat moves at a low speed.

Additionally, respective grip portions 75*b* of the operational levers 75 have surfaces that oppose one another so that the rider can grasp both of the grip portions 75*b* one-handed to operate them simultaneously. Shift switches 76 can be connected to the operational levers 75 and can be placed at forward or reverse positions in response to operational conditions of the operational levers 75. The shift switches 76 transmit signals indicative of the positions thereof to the respective controllers 70. Further, the respective devices shown in FIG. 6 are connected to the controllers 70. The respective devices can be the same as those described above with reference to FIGS. 1-10. Thus, the same portions can be assigned the same reference numerals or symbols and are not repeated below.

With the boat of FIG. 11, the speed control device can be controlled in accordance with the flowchart described above and illustrated in FIGS. 7 and 8. Thus, the respective engines can operate in response to the operational conditions of the associated operational levers 75, and thus the boat can turn or run straight ahead in a planing mode in response to operational conditions of the steering device 72. Additionally, where the speed control device has no sensor for detecting the steering load, the process at the step 138 can be omitted. Thus, the propulsive force of the boat can be greatly improved, and the boat can continue a normal running condition even if a malfunction occurs on one of the engines.

The boats and watercrafts described herein are not limited to the embodiments described above but can be properly modified. For example, the respective embodiments described above employ a mechanism in which the throttle lever 55 and the throttle valve 36*a*, and also the operational lever 75 and the throttle valve 36*a* are coupled with each other using the respective mechanical throttle cables 55*a*. However, a mechanism incorporating electronically controlled throttle valves can replace the mechanism described above. In this alternative, a position sensor or the like and a throttle valve opening and closing device that having a motor can be provided.

The position sensor, for example, can act as a drive operation detecting device that detects an operational position of the throttle lever 55 or the operational lever 75. The throttle valve opening and closing device pivotally actuates the throttle valve 36*a* based upon a detection amount of the position sensor or the like.

Also, the boats and watercrafts described above can include a step for the rider to stand on in a rear portion of the boat, can be in the form of a relatively large boat that has a cockpit on the deck, or can be in the form of a type of boat that has the seat 13 (FIG. 1). In addition, boats for leisure use, fishing boats or the like can have the speed control device described herein.

Although the speed set mode is controlled based upon the engine rotational speed in the embodiments described above, the boat may have a boat speed sensor (not shown) to control the speed set mode based upon a detection value of a boat speed that is detected by the boat speed sensor.

Further, in the embodiment described above, both of the fuel injection amount and the ignition timing can be adjusted when the speed mode is changed to the speed set mode. However, either or both of them can be adjusted.

With regard to the speed setting operator, a variety of switches can be used, instead of the auto cruise switch 56 as a single pushbutton switch unit. For example, the speed setting operator can comprise an on-use only switch and an off-use only switch. The speed mode can thus be changed to the speed set mode only when the on-use switch is pushed, and the speed mode can return to the regular mode when the off-use switch is pushed. Also, the speed setting operator may comprise a foot pedal or a reciprocal lever. Further, structures of the other parts can be suitably modified within the scope of art of the present invention.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A speed control device for a water jet propulsion boat that includes a power output request device and an engine adapted to operate in response to an operation of the power output request device by a rider, the speed control device comprising a speed setting operator configured to be operated by the rider, a speed setting operation detecting device configured to detect an operational condition of said speed setting operator, a speed mode changing device configured to change a speed mode based upon a detection result of said speed setting operation detecting device between a regular mode in which the engine operates in response to an operation of said drive operator by the rider and a speed set mode in which said water jet propulsion boat runs at a preset running speed or at a preset engine rotational speed, an engine rotational speed detecting device configured to detect a rotational speed of the engine, and a speed mode returning device configured to return the speed mode from the speed set mode to the regular mode when a detection value detected by said engine rotational speed detecting device in the speed set mode is zero or less than a predetermined value.

2. The speed control device for a water jet propulsion boat according to claim 1, wherein said speed mode changing device is configured to change the speed mode to the speed set mode when said speed setting operation detecting device detects that an operational condition of said speed setting operator becomes a condition corresponding to the speed set mode after said speed setting operation detecting device has detected that the operational condition of said speed setting operator corresponds to a condition of the regular mode.

3. The speed control device for a water jet propulsion boat according to claim 1, wherein the speed control device is configured such that a period of time in which the engine rotational speed or the running speed reaches a preset value when the speed mode is changed to the speed set mode from the regular mode is longer than another period of time in which the engine rotational speed or the running speed reaches the preset amount when the speed mode is changed to the regular mode from the speed set mode.

4. The speed control device for a water jet propulsion boat according to claim 1 further comprising a propulsion device driven by the engine and a shift mechanism configured to change a propulsion mode of the propulsion device between a forward mode and a reverse mode, wherein the speed control device is configured such that a change to the speed set mode by said speed mode changing device is prohibited when the shift mechanism is in a mode other than the forward mode.

5. The speed control device for a water jet propulsion boat according to claim 4, wherein the speed control device is configured to change the speed mode to the regular mode if the propulsion device is shifted into the reverse mode.

6. The speed control device for a water jet propulsion boat according to claim 1 further comprising a propulsion device driven by the engine and a shift mechanism configured to change a propulsion mode of the propulsion device between a forward mode and a reverse mode, wherein the speed control device is configured to change the speed mode to the regular mode if the propulsion device is shifted into the reverse mode.

7. The speed control device for a water jet propulsion boat according to claim 1 further comprising an operator informing device configured to inform an operator of the boat when the speed mode changes between the regular mode and the speed set mode.

8. The speed control device for a water jet propulsion boat according to claim 1, wherein the speed setting operator is connected to the speed mode changing device through a lead wire, wherein the speed control device is configured such that a change to the speed set mode by said speed mode changing device is prohibited when the lead wire is broken or is short-circuited.

9. The speed control device for a water jet propulsion boat according to claim 8, wherein the speed control device is configured to change the speed mode to the regular mode if the lead wire is broken or is short-circuited.

10. The speed control device for a water jet propulsion boat according to claim 1, further comprising a steering device and a steering amount detecting device for detecting at least one of a steering angle of the steering device and a steering load applied to the steering device, wherein the speed control device is configured to return the speed mode to the regular mode when a detection amount detected by said steering amount detecting device exceeds a preset value.

11. The speed control device for a water jet propulsion boat according to claim 1 further comprising a throttle valve configured to meter an amount of air moving into the engine and a power output request detecting device configured to detect an operational condition of the power output request device, wherein the speed control device is configured to prohibit a change to the speed set mode by the speed mode changing device when the detection amount detected by the power output request detecting device exceeds a preset value, and wherein the speed control device is further configured, if the speed mode has been already changed to the speed set mode, to change the speed mode is to the regular mode with the speed mode returning device.

12. A speed control device for a water jet propulsion boat that includes a power output request device and an engine adapted to operate in response to an operation of the power output request device by a rider, the speed control device comprising a speed setting operator configured to be operated by the rider, a speed setting operation detecting device configured to detect an operational condition of said speed setting operator, a speed mode changing device configured to change a speed mode based upon a detection result of said speed setting operation detecting device between a regular mode in which the engine operates in response to an operation of said drive operator by the rider and a speed set mode in which said water jet propulsion boat runs at a preset running speed or at a preset engine rotational speed, an engine rotational speed detecting device configured to detect a rotational speed of the engine, and a speed mode returning device configured to return the speed mode from the speed set mode to the regular mode when a detection value detected by said engine rotational speed detecting device in the speed set mode is zero or less than a predetermined value, further comprising return means for retuning said speed setting operator to an un-operational condition when said speed setting operator is released from the operation of the rider, and a timer for measuring an operation time of said speed setting operator operated by the rider, wherein the speed mode changing device is configured to change from the regular mode to the speed set mode only when the operation time of said speed setting operator measured by said timer exceeds a first preset time.

13. The speed control device for a water jet propulsion boat according to claim 12, wherein the speed mode changing device is configured to change from the speed set mode to the regular mode only when the operation time of said speed setting operator measured by said timer exceeds a second preset time, wherein the first preset time is longer than the second preset time.

14. A speed control device for a water jet propulsion boat that includes a power output request device and an engine adapted to operate in response to an operation of the power output request device by a rider, the speed control device comprising a speed setting operator configured to be operated by the rider, a speed setting operation detecting device configured to detect an operational condition of said speed setting operator, a speed mode changing device configured to change a speed mode based upon a detection result of said speed setting operation detecting device between a regular mode in which the engine operates in response to an operation of said drive operator by the rider and a speed set mode in which said water jet propulsion boat runs at a preset running speed or at a preset engine rotational speed, an engine rotational speed detecting device configured to detect a rotational speed of the engine, and a speed mode returning device configured to return the speed mode from the speed set mode to the regular mode when a detection value detected by said engine rotational speed detecting device in the speed set mode is zero or less than a predetermined value, wherein the speed control device is configured to prohibit a change to the speed set mode when a detection amount detected by said engine rotational speed detecting device exceeds a preset value.

15. A speed control device for a water jet propulsion boat that includes a power output request device and an engine adapted to operate in response to an operation of the power output request device by a rider, the speed control device comprising a speed setting operator configured to be operated by the rider, a speed setting operation detecting device configured to detect an operational condition of said speed setting operator, a speed mode changing device configured to change a speed mode based upon a detection result of said speed setting operation detecting device between a regular mode in which the engine operates in response to an operation of said drive operator by the rider and a speed set mode in which said water jet propulsion boat runs at a preset running speed or at a preset engine rotational speed, an engine rotational speed detecting device configured to detect a rotational speed of the engine, and a speed mode returning device configured to return the speed mode from the speed set mode to the regular mode when a detection value detected by said engine rotational speed detecting device in the speed set mode is zero or less than a predetermined value, wherein the speed control device is configured to return the speed mode to the regular mode if a detection amount detected by said engine rotational speed detecting device exceeds a preset value.

* * * * *

UNITED STATES PATENT AND TRADEMARK OFFICE

CERTIFICATE OF CORRECTION

PATENT NO. : 7,647,143 B2
APPLICATION NO. : 11/135890
DATED : January 12, 2010
INVENTOR(S) : Ito et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1268 days.

Signed and Sealed this

Sixteenth Day of November, 2010

David J. Kappos

David J. Kappos
*Director of the United States Patent and Trademark Office*